US009469136B2

(12) United States Patent
Arimori et al.

(10) Patent No.: US 9,469,136 B2
(45) Date of Patent: Oct. 18, 2016

(54) LIQUID EJECTING APPARATUS

(71) Applicant: SEIKO EPSON CORPORATION, Tokyo (JP)

(72) Inventors: Kazuhiko Arimori, Fukuoka (JP); Kosuke Nomoto, Fukuoka (JP); Kazuya Yoshikaie, Fukuoka (JP); Satoshi Nakata, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/831,156

(22) Filed: Aug. 20, 2015

(65) Prior Publication Data

US 2016/0059601 A1 Mar. 3, 2016

(30) Foreign Application Priority Data

Aug. 26, 2014 (JP) ..... 2014-171266

(51) Int. Cl.

| | |
|---|---|
| ***B41J 29/393*** | (2006.01) |
| ***B41J 2/045*** | (2006.01) |
| ***B41J 2/21*** | (2006.01) |
| ***B41J 19/14*** | (2006.01) |

(52) U.S. Cl.

CPC ..... *B41J 29/393* (2013.01); *B41J 2/04503* (2013.01); *B41J 2/04505* (2013.01); *B41J 2/04506* (2013.01); *B41J 2/04548* (2013.01); *B41J 2/04558* (2013.01); *B41J 2/2132* (2013.01); *B41J 2/2135* (2013.01); *B41J 19/145* (2013.01)

(58) Field of Classification Search

CPC ..... B41J 2/04503; B41J 2/04505; B41J 2/04506; B41J 2/04558; B41J 2/04548; B41J 2/2132; B41J 2/2135; B41J 19/145

See application file for complete search history.

(56) References Cited

U.S. PATENT DOCUMENTS 6,334,720 B1 * 1/2002 Kato ..... B41J 29/393 400/118.2

FOREIGN PATENT DOCUMENTS

| | | |
|---|---|---|
| JP | 06-015879 A | 1/1994 |
| JP | 2002-292959 A | 10/2002 |

* cited by examiner

*Primary Examiner* — Julian Huffman

(74) *Attorney, Agent, or Firm* — Global IP Counselors, LLP

(57) ABSTRACT

When a power supply mode is an AC power mode, if a correction value which is read out from a non-volatile memory is a second correction value α2 corresponding to a battery mode, a first correction value α1 is calculated according to an equation α1=α2×K2 using the second correction value α2, and bidirectional printing is performed by controlling an ejection timing of a print head based on the first correction value α1. Meanwhile, when a power supply mode is the battery mode, if the correction value is the first correction value α1 corresponding to the AC power mode, the second correction value α2 is calculated according to an equation α2=α1×K1 using the first correction value α1, and bidirectional printing is performed by controlling the ejection timing of the print head based on the second correction value α2.

8 Claims, 11 Drawing Sheets

FIG. 9A

FIRST CORRECTION VALUE $\alpha 1$ SAVED

| POWER SUPPLY MODE | CORRECTION VALUE | |
|---|---|---|
| AC POWER (HIGH SPEED) | $\alpha 1$ | ← CD |
| BATTERY (LOW SPEED) | $\alpha 2=\alpha 1 \times K1$ | ← CALCULATION |

FIG. 9B

SECOND CORRECTION VALUE $\alpha 2$ SAVED

| POWER SUPPLY MODE | CORRECTION VALUE | |
|---|---|---|
| AC POWER (HIGH SPEED) | $\alpha 1=\alpha 2 \times K2$ | ← CALCULATION |
| BATTERY (LOW SPEED) | $\alpha 2$ | ← CD |

LIQUID EJECTING APPARATUS

BACKGROUND

1. Technical Field

The present invention relates to a liquid ejecting apparatus provided with a liquid ejecting head capable of ejecting a liquid from a plurality of nozzles while moving reciprocally relative to a medium such as paper.

2. Related Art

In the related art, an ink jet printer (hereinafter also referred to simply as "a printer") which performs printing on a medium such as paper by ejecting an ink (an example of a liquid) from a plurality of nozzles of a liquid ejecting head is widely known as a liquid ejecting apparatus which ejects a liquid onto a medium such as paper. Among such printers, there is a printer in which the liquid ejecting head is rendered capable of reciprocal movement in a scanning direction which orthogonally intersects a transport direction of the paper, and the printer has a printing mode in which bidirectional printing in which the ink is ejected onto the paper in both an outward motion and a return motion of the liquid ejecting head is performed.

In this type of printer, an image is formed (printed) due to ink droplets which are ejected from the nozzles of the liquid ejecting head during both the outward motion and the return motion landing on the paper in pixel positions which are set at a fixed pitch in the scanning direction. Therefore, in order to obtain a clear printed image in the printer, when the same pixel position in the scanning direction is set as a target, it is necessary to cause the landing position in the scanning direction of the ink droplets which land on the paper to match during the outward motion and during the return motion of the liquid ejecting head.

However, in the bidirectional printing in which the liquid ejecting head moves in opposite directions during the outward motion and the during return motion, a flight path of an ink droplet which is ejected vertically toward the surface of the medium from the liquid ejecting head which moves adopts a diagonal path which inclines to the opposite side alternately during the outward motion and during the return motion due to the influence of a speed vector in a movement direction of the liquid ejecting head. Therefore, in the bidirectional printing, the ejection timing (the ejection position) during the outward motion and during the return motion of the liquid ejecting head is adjusted using a correction value (an adjustment value). However, even if an appropriate correction value is set when the printer is shipped, there is a case in which the value of the correction value becomes inappropriate due to degradation with the passage of time or the like and print shifting in the scanning direction between during the outward motion and during the return motion of the liquid ejecting head occurs.

Therefore, in a printer (a print control device) disclosed in JP-A-2002-292959, for example, a test pattern containing a plurality of inspection patterns (for example, ruled line pairs) in which the shift amounts of the landing positions of the ink droplets differ is printed onto the paper during the outward motion and the return motion of the liquid ejecting head. A Bi-D adjustment in which the correction value (the adjustment value) for the bidirectional printing is updated to an appropriate value is performed by inputting selection data such as a number corresponding to the inspection pattern with the smallest shift amount from the printed result of the test pattern to the printer by operating an operation unit.

Incidentally, in a printer which has a plurality of printing modes in which the movement speed of the liquid ejecting head differs, the correction value (the adjustment value) during the bidirectional printing differs for each of the plurality of printing modes. Therefore, in the printer disclosed in JP-A-2002-292959, it is necessary to perform Bi-D adjustment work in which a test pattern is printed, and one condition with the smallest print shifting from the printed result of the test pattern is selected and set for each printing mode with a different carriage speed.

SUMMARY

An advantage of some aspects of the invention is to provide a liquid ejecting apparatus in which it is sufficient not to perform setting work of a correction value which determines an ejection timing during both an outward motion and a return motion of a liquid ejecting head which is used in bidirectional printing for each different speed mode.

Hereinafter, means of the invention and operation effects thereof will be described.

According to an aspect of the invention, there is provided a liquid ejecting apparatus including: a liquid ejecting head which is capable of ejecting a liquid; a carriage which is capable of moving reciprocally in a scanning direction which intersects a transport direction of a medium; a control unit which causes the liquid ejecting apparatus to perform bidirectional printing by causing the carriage to move reciprocally in a plurality of speed modes in which an ejection mode of the liquid ejecting head is the same and a movement speed of the carriage is different, and causing the liquid to be ejected from a nozzle of the liquid ejecting head in both an outward motion and a return motion of the carriage; a correction value acquisition unit which performs the bidirectional printing of a test pattern using a correction value which corresponds to one speed mode of the plurality of speed modes, acquires a correction value based on a printed result of the test pattern, and stores correction information containing information of the speed mode of when the test pattern is printed and the correction value in a storage unit; and a correction unit which corrects an ejection timing of the liquid ejecting head according to the speed mode which is applied based on the correction information.

In this case, the correction value acquisition unit performs the bidirectional printing of the test pattern using the correction value which corresponds to one speed mode of the plurality of speed modes, acquires a correction value based on the printed result of the test pattern, and stores correction information containing information of the speed mode of when the test pattern is printed and the correction value in the storage unit. The correction unit corrects the ejection timing according to the speed mode which is applied based on the speed mode information and the correction value contained in the correction information. In other words, if the speed mode which is applied is the same as the speed mode information, the ejection timing is corrected based on the correction value. Meanwhile, when the speed mode which is applied is different from the speed mode information, using the correction value in the correction information, the correction value corresponding to the speed mode which is applied is acquired by calculation, and the ejection timing is corrected based on the correction value which is acquired in the calculation. Accordingly, it is not necessary to perform setting work of the correction value which determines the ejection timing during both the outward motion and the return motion of the liquid ejecting head which is used in the bidirectional printing for each different speed mode.

In this case, it is preferable that the liquid ejecting apparatus further includes a power supply unit which is capable of selecting a first power supply which converts an alternating current from an alternating current power source to a direct current and supplies power, and a second power supply which supplies a direct current from a battery, in which the plurality of speed modes contains a first power supply mode in which the movement speed of the carriage during the first power supply is set to a relatively high speed, and a second power supply mode in which the movement speed of the carriage during the second power supply is set to a relatively low speed in comparison to during the first power supply, in which the correction value acquisition unit performs the bidirectional printing of the test pattern in one power supply mode of the first power supply mode and the second power supply mode, acquires a correction value based on a printed result of the test pattern, and stores correction information containing information of the power supply mode of when the correction value is obtained and the correction value in the storage unit, and in which the correction unit obtains a correction value which corrects the ejection timing of the liquid ejecting head in the power supply mode which is applied based on the power supply mode which is applied and the correction information.

In this case, the plurality of speed modes contains the first power supply mode in which the movement speed of the carriage during the first power supply is set to a relatively high speed, and the second power supply mode in which the movement speed of the carriage during the second power supply is set to a relatively low speed in comparison to during the first power supply. The correction value acquisition unit performs the bidirectional printing of the test pattern in one of the speed modes of the first speed mode in the first power supply and the second speed mode in the second power supply, acquires a correction value based on the printed result of the test pattern, and stores the correction information containing the information of the power supply mode of when the correction value is obtained and the correction value in the storage unit. The correction unit obtains the correction value which corrects the ejection timing of the liquid ejecting head in the power supply mode which is applied based on the power supply mode which is applied and the correction information. Accordingly, it is not necessary to perform the setting work of the correction value which determines the ejection timing during both the outward motion and the return motion of the liquid ejecting head which is used in the bidirectional printing for each different power supply mode, even when the movement speed of the carriage differs according to the plurality of power supply modes with different power supplies from the power supply unit.

In this case, it is preferable that when a power supply which is performed by the power supply unit during printing in which the carriage and the liquid ejecting head are controlled changes from the first power supply to the second power supply, the control unit stops ejection of the liquid from the liquid ejecting head and outputs the medium which is a target of the stopped liquid ejection.

In this case, when the power supply which is performed by the power supply unit during the printing in which the carriage and the liquid ejecting head are controlled changes from the first power supply to the second power supply, the control unit stops ejection of the liquid from the liquid ejecting head and outputs the medium which is a target of the stopped liquid ejection. When the power supply by the power supply unit changes from the first power supply to the second power supply, for example, when the speed mode is switched, since lines are formed in the printed image, the speed mode may not be changed, whereas, when the speed mode is maintained at a high speed, there is a concern that the system will go down. In this case, it is possible to avoid the system of the liquid ejecting apparatus going down. It is possible to avoid the formation of lines in the printed image or the system of the liquid ejecting apparatus going down due to the ejection of the liquid from the liquid ejecting head being stopped and the medium being output.

In this case, it is preferable that when the power supply which is performed by the power supply unit during the printing in which the carriage and the liquid ejecting head are controlled changes from the second power supply to the first power supply part way through a scan of the carriage, the control unit continues control in the second power supply mode during the scan, switches to control of the first power supply mode from a next scan of the carriage, and controls the ejection timing of the liquid ejecting head using the correction value of the first power supply mode.

In this case, when the power supply which is performed by the power supply unit during the printing in which the carriage and the liquid ejecting head are controlled changes from the second power supply to the first power supply part way through a scan of the carriage, the control unit controls the carriage at the speed and the ejection timing of the second power supply mode during the scan, switches to control of the first power supply mode from a next scan of the carriage, and controls the ejection timing of the liquid ejecting head using the correction value of the first power supply mode. As a result, in addition to being able to avoid the formation of the lines in the printed image caused by a variation in the carriage speed part way through a pass, it is possible to perform the bidirectional printing in the high speed mode using the first power supply from the next pass.

In the liquid ejecting apparatus, it is preferable for the correction value acquisition unit to overwrite the correction value in the storage unit with a correction value which is subsequently acquired.

In this case, the correction value in the storage unit is overwritten by the correction value acquisition unit with the correction value which is subsequently acquired. Therefore, it is sufficient for the storage capacity of the storage unit which is necessary to store the correction value to be small.

In the liquid ejecting apparatus, it is preferable that, when correction is carried out on the ejection timing which aligns landing positions of the liquid in both directions during the bidirectional printing in one speed mode of the plurality of speed modes, and when the bidirectional printing is performed in another speed mode, the correction value which is acquired in the one speed mode is multiplied by a coefficient corresponding to the other speed mode to acquire a correction value of when the bidirectional printing is performed in the other speed mode.

In this case, when the correction is carried out on the ejection timing which aligns landing positions of the liquid in both directions in the bidirectional printing in one speed mode of the plurality of speed modes, and when the bidirectional printing is performed in another speed mode, the correction value which is acquired in the one speed mode is multiplied by a coefficient corresponding to the other speed mode to acquire a correction value of when the printing is performed in the other speed mode. Accordingly, one correction value is sufficient.

In the liquid ejecting apparatus, it is preferable that, when the control unit forms a first test pattern by performing the bidirectional printing in the one speed mode when correcting the ejection timing which aligns the landing positions of the liquid in both directions during the bidirectional printing in the one speed mode of the plurality of speed modes, and acquires a correction value based on a printed result of the first test pattern, the control unit calculates a correction value of the other speed mode based on the acquired correction value and prints a second test pattern in the other speed mode based on the calculated correction value.

In this case, when the control unit forms the first test pattern by performing the bidirectional printing when correcting the ejection timing during the bidirectional printing in the one speed mode of the plurality of speed modes, and acquires a correction value based on a printed result of the first test pattern, the control unit calculates a correction value of the other speed mode based on the acquired correction value and prints a second test pattern in the other speed mode based on the calculated correction value. Accordingly, it is possible to determine whether or not the calculated correction value is appropriate by viewing the printed result of the second test pattern. For example, from the printed result of the second test pattern, when the correction value which is calculated in advance is inappropriate, it becomes possible to calculate the appropriate correction value by correcting the computation equation by correcting the coefficient in the computation equation or the like.

In the liquid ejecting apparatus, it is preferable that after outputting the medium for which the printing of the first test pattern is complete, the control unit performs notification indicating that the medium is to be set in a feed position using a notification unit, and prints the second test pattern onto a different printing area from the printing area of the first test pattern on the medium.

In this case, since the first test pattern and the second test pattern are printed onto one sheet of the medium, it is possible to confirm the first test pattern and the second test pattern on one sheet of the medium. Accordingly, even if the second test pattern is printed, it is sufficient for one sheet of the medium to be consumed in the printing of the test patterns. Since the first test pattern and the second test pattern are printed on different printing areas of the surface of the same side of the same sheet of the medium, it is easy to compare the test patterns to each other.

In the liquid ejecting apparatus, it is preferable that, when a calculated second correction value which is obtained by calculation using a first correction value which is selected from the printed result of the first test pattern differs from the actual second correction value which is selected from the printed result of the second test pattern in excess of a permissible range, the control unit performs learning in which a numerical constant which is used in the calculation is updated to a value which is obtained using the actual second correction value.

In this case, it is possible to repair mismatching of a numerical constant in the computation equation caused by degradation with the passage of time or the like using a learning function. Therefore, even if the correction value obtained using the calculation is used, it is possible to print with relatively high print quality over a long period.

BRIEF DESCRIPTION OF THE DRAWINGS

The invention will be described with reference to the accompanying drawings, wherein like numbers reference like elements.

FIG. 9A is a schematic diagram illustrating a correction value acquisition method for each power supply mode when a first correction value is saved. FIG. 9B is a schematic diagram illustrating a correction value acquisition method for each power supply mode when a second correction value is saved.

DESCRIPTION OF EXEMPLARY EMBODIMENTS

Hereinafter, description will be given of an embodiment of a printer which is an example of the liquid ejecting apparatus, with reference to the drawings.

Figure 1:
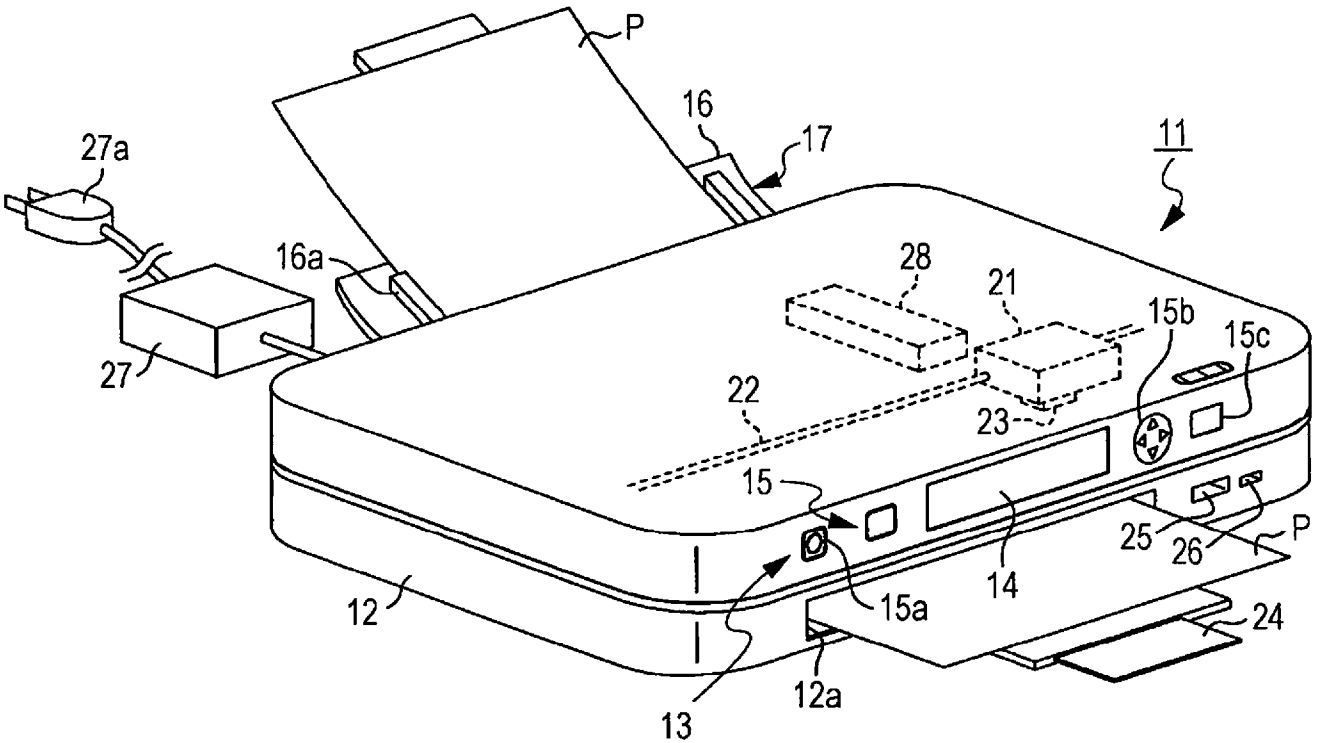
FIG. 1 is a perspective diagram illustrating a printer in an embodiment.

As illustrated in FIG. 1, a printer 11 is an ink jet color printer, for example, and is provided with an apparatus main body 12 which has a substantially thin rectangular cuboid shape. An operation panel 13 which is used in an input operation or the like of a user is provided on a front surface (the right surface in FIG. 1) of the apparatus main body 12. An operation unit 15 which is formed of a display unit 14 formed of a liquid crystal panel, for example, and a plurality of operation switches is provided on the operation panel 13. The operation unit 15 includes a power switch 15*a*, a selection switch 15*b* which is operated when selecting a desired selection item on a menu screen of the display unit 14, and a cancel switch 15*c*. A "Bi-D adjustment" (described later) is included as a maintenance item when the selection switch 15*b* is operated to select the maintenance item from the menu screen. Note that, in the present embodiment, the display unit 14 corresponds to an example of a notification unit.

As illustrated in FIG. 1, an automatic feeding device 17 is provided on a rear surface portion of the apparatus main body 12. The automatic feeding device 17 is provided with a feed tray 16 which includes a pair of edge guides 16*a* capable of positioning a paper P in a width direction. Note that, the automatic feeding device 17 is not limited to a hopper system supply system provided with the feed tray 16, and may be a roll feed system in which roll paper which is set on the outside or the inside of the apparatus main body 12 is let out and fed, or a cassette feeding system in which paper is fed, one sheet at a time, from a paper group which is set in a feed cassette which is detachably inserted into the apparatus main body 12.

As illustrated in FIG. 1, a carriage 21 is provided inside the apparatus main body 12 in a state of being capable of reciprocal movement in a scanning direction X, guided by a guide shaft 22. A print head 23 which is capable of ejecting ink droplets onto the paper P which is fed from the automatic feeding device 17 is attached to the bottom portion of the carriage 21. The paper P is intermittently transported in a transport direction Y which intersects the scanning direction X during the printing, printing is carried out, one scan worth at a time, due to the carriage 21 ejecting the ink droplets from nozzles 23*b* (refer to FIG. 3) of the print head 23 while moving in the scanning direction X while the paper P is stationary between each transportation, and documents and images are printed on the paper P due to the aforementioned process being repeated for a plurality of scans. The printed paper P is output from an output port 12*a* of the front surface of the apparatus main body 12, and is stacked on a sliding output stacker 24 (an output tray) which is set to an extended state.

A USB port 25, a card slot 26, and a wireless LAN interface (for example, "Wi-Fi" (registered trademark), not shown) are provided on a front surface side end portion (in FIG. 1, the right end portion, for example) of the apparatus main body 12. It is possible to cause the printer 11 to print an image or the like by loading image data or the like from an external storage device which is connected to the USB port 25 (for example, USB memory), a memory card which is connected to the card slot 26, receiving the image data or the like wirelessly from a portable host device (for example a smart phone or a mobile telephone) via the wireless LAN interface, or the like.

Figure 5:
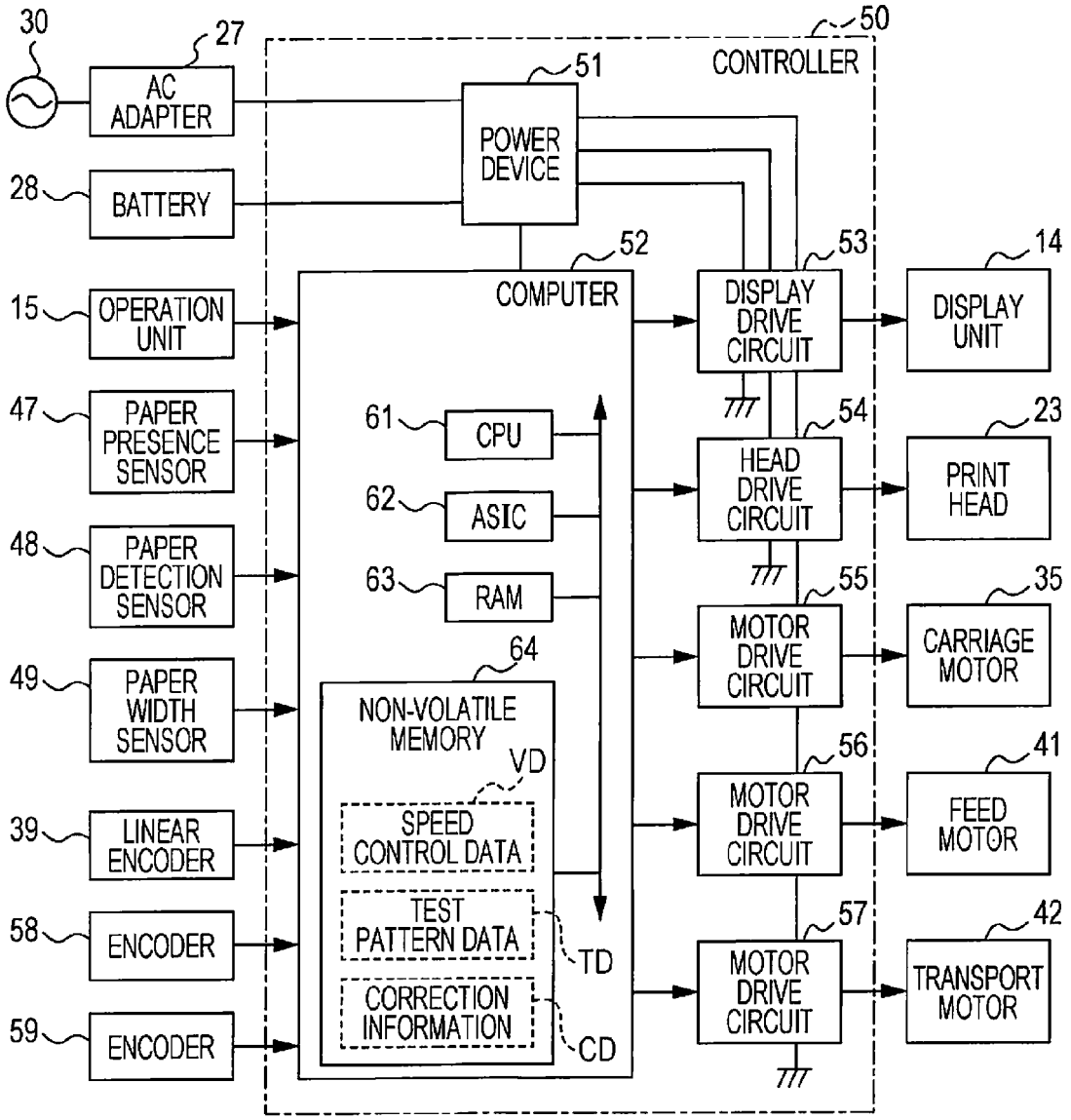
FIG. 5 is a block diagram illustrating the electrical configuration of the printer.

A power jack which is capable of being connected to a power supply plug of an output side of an AC adapter 27 which includes a power plug 27*a* capable of being plugged into an electrical outlet of a commercial power source 30 (refer to FIG. 5) is provided in the apparatus main body 12 (neither the power plug 27*a* nor the apparatus main body 12 is depicted in FIG. 5). An alternating current from the commercial power source 30 is converted to a direct current by the AC adapter 27, the power of a predetermined voltage of the direct current is supplied to the printer 11. A battery 28 is stored in the apparatus main body 12 as a power source which can be used when carrying the printer 11 or the like. For the battery 28, a battery which has a comparatively small capacity and the size is small is used to obtain a reduction in the size of the printer. Therefore, a power Wb (a battery supply power) which may be supplied by the battery 28 is smaller than a power Wac (AC power) which may be supplied via the AC adapter 27 (Wb<Wac). Naturally, although the battery 28 will increase in size a little, the battery 28 may be a battery which is capable of outputting the battery supply power Wb which has the same value as the AC power supply power Wac from the AC adapter 27.

Figure 2:
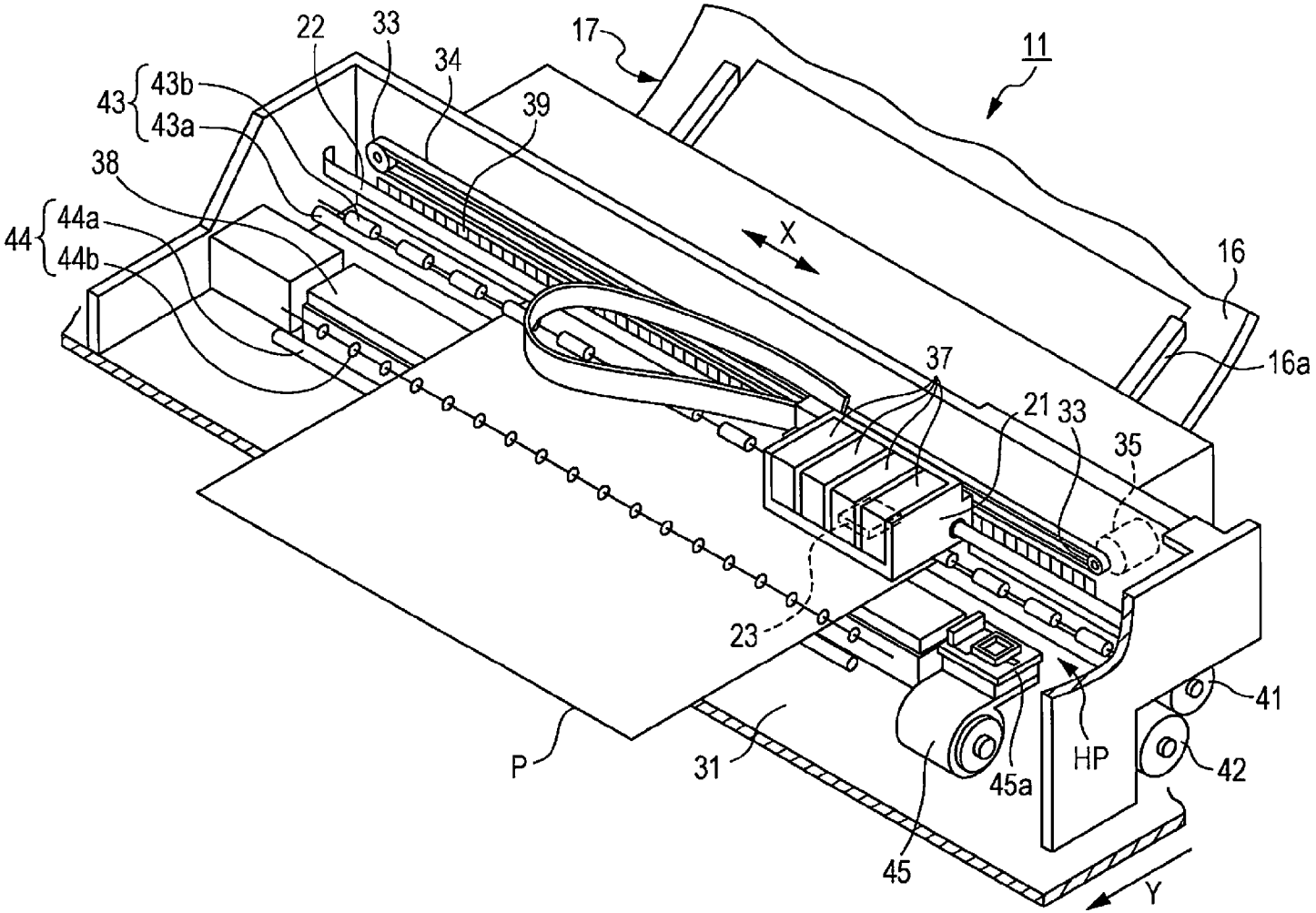
FIG. 2 is a schematic perspective diagram illustrating the printer in a state in which an exterior cover is removed.

Next, description will be given of the internal configuration of the printer 11, with reference to FIG. 2. As illustrated in FIG. 2, in a substantially square box shaped main body frame 31 which opens on the top side and the front side of the printer 11, the carriage 21 described earlier is provided, in a state of being capable of moving reciprocally in the scanning direction X, on the guide shaft 22 which bridges between the left and right side walls in FIG. 2. An endless timing belt 34 is wound around a pair of pulleys 33 which are attached to the rear plate inside surface of the main body frame 31, and the carriage 21 is fixed to a portion of the timing belt 34. The pulley 33 of the right side in FIG. 2 communicates with a drive shaft (an output shaft) of the carriage motor 35, and the carriage 21 moves reciprocally in the scanning direction X via the timing belt 34 which rotates forward or backward due to a carriage motor 35 being driven forward or backward.

A plurality of (for example, 4) ink cartridges 37, stored in which are four colors of ink, black (K), cyan (C), magenta (M), and yellow (Y), for example, are mounted to the top portion of the carriage 21. The inks which are supplied from the ink cartridges 37 are ejected from nozzle groups for different ink colors which are opened in the bottom surface of the print head 23. A support stand 38 which supports the paper P from underneath and defines the interval (the gap) between the print head 23 and the paper P is provided beneath the movement path of the carriage 21 so as to extend along the scanning direction X. Note that, the print head 23 is not limited to four colors of ink which may be ejected, and there may be 3 colors, 5 to 8 colors, and furthermore, may be one color of black.

A linear encoder 39 which outputs a number of pulses proportional to the movement amount of the carriage 21 is provided on the main body frame 31 so as to extend along the movement path of the carriage 21. In the printer 11, the position control and the speed control of the carriage 21 and the control of the ink ejection timing of the print head 23 are performed based on the pulse signal which is output from the linear encoder 39.

A feed motor 41 which is provided on the right end bottom portion of the main body frame 31 in FIG. 2 supplies a plurality of sheets of the paper P which is set in the feed tray 16 (refer to FIG. 1), one sheet at a time due to a feed roller (not shown) which configures the automatic feeding device 17 being rotationally driven. A transport motor 42 drives a transport roller pair 43 and an output roller pair 44 which are respectfully provided on the upstream side and the downstream side of the support stand 38 to interpose the support stand 38 in the transport direction Y. The roller pairs 43 and 44 are respectively formed of drive rollers 43*a* and 44*a* and driven rollers 43*b* and 44*b*. The drive rollers 43*a* and 44*a* rotate using the motive force of the transport motor 42, and the driven rollers 43*b* and 44*b* abut the drive rollers 43*a* and 44*a* and are led thereby to rotate. The paper P is transported in the transport direction Y due to both of the roller pairs 43 and 44 rotating due to the motive force of the transport motor 42 in a state in which the paper P is nipped at two locations in the transport direction Y by both of the roller pairs 43 and 44. Note that, in the present embodiment, an example of the transport mechanism is configured by a feed mechanism which is provided with a feed roller and the like, and a conveying mechanism which is provided with both of the roller pairs 43 and 44 which convey the paper P to the next printing position during the printing.

In FIG. 2, one end position (the right end position in FIG. 2) on the movement path of the carriage 21 is a home position HP at which the carriage 21 waits when the printing is not underway. A maintenance device 45 which carries out maintenance of the print head 23 is disposed directly beneath the carriage 21 which is disposed in the home position. The maintenance device 45 is driven by the transport motor 42, which is a motive power source of the transport system, as the motive power source. The maintenance device 45 is provided with a cap 45*a* which caps the print head 23 at the home position HP.

In the printer 11 of the serial system, documents, images, and the like are printed on the paper P by alternately repeating a print operation and a conveying operation. In the print operation, the ink is ejected from the nozzles of the print head 23 onto the paper P while the carriage 21 is caused to move reciprocally in the scanning direction X, and in the conveying operation, the paper P is transported in the transport direction Y by a transport amount to the next printing position. In the printer 11, bidirectional printing and unidirectional printing are carried out as the printing systems. In the bidirectional printing, the ink droplets are ejected both (in both directions) during the outward motion in which the print head 23 moves in a direction away from the home position HP and during the return motion in which the print head 23 moves in a direction approaching the home position HP, and in the unidirectional printing, the ink droplets are only ejected during the outward motion of the print head 23, and the carriage 21 is only returned during the return motion. For example, a plurality of printing modes are prepared. During the printing of a photograph or the like, a high quality printing mode (for example "beautiful mode") in which the print quality is prioritized over the printing speed is selected, and during the printing of a document or the like, an ordinary printing mode (for example "normal mode") in which the printing speed is prioritized over the print quality is selected. For example, in the high quality printing mode, unidirectional printing is performed, and in the ordinary printing mode, the bidirectional printing is performed.

Figure 3:
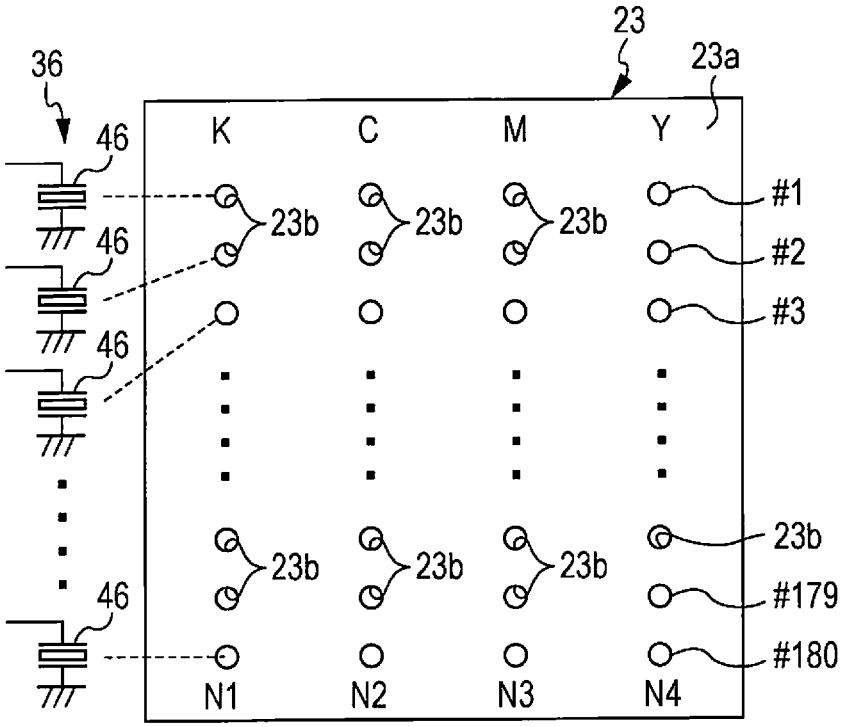
FIG. 3 is a schematic bottom view illustrating a print head and ejection drive elements.

As illustrated in FIG. 3, the same number (for example, 4 rows) of nozzle rows N1 to N4 as the number of ink colors corresponding to the plurality of ink colors (for example, 4 colors), each of which is formed of the nozzles 23*b* which are numbered #1 to #180 for a total of 180 of the nozzles 23*b* which are arranged in a single row at a fixed nozzle pitch in the transport direction Y (the up-down direction in FIG. 3), are formed in a nozzle opening surface 23*a* of the print head 23. In the present example, the printing is performed with the four colors of black (K), cyan (C), magenta (M), and yellow (Y), for example, using the total of four nozzle rows N1 to N4.

As illustrated in FIG. 3, the print head 23 contains the same number of ejection drive elements 46 as the number of nozzles for each nozzle row, one ejection drive element 46 corresponding to each of the 180 nozzles 23*b* #1 to #180. An ejection drive element group 36 is formed of a plurality (for example, 720) of the ejection drive elements 46, enough for the number of nozzle rows. Note that, FIG. 3 schematically depicts only the ejection drive elements 46 corresponding to the 180 nozzles 23*b* #1 to #180 which form the nozzle row N1 on the outside of the print head 23. The ejection drive element 46 is formed of a piezoelectric vibrator or a electrostatic drive element, for example, and, when a drive pulse (a voltage pulse) of a predetermined drive waveform is applied, an inner wall portion (a diaphragm) of an ink chamber which communicates to the nozzle 23*b* is caused to vibrate by an electrostriction effect or an electrostatic effect, and the ink droplet is ejected from the nozzle 23*b* by causing the ink chamber to expand and contract. Note that, in addition to a piezoelectric drive element (a piezo element) and an electrostatic drive element, another example of the ejection drive element is a heater element which heats the ink and causes an ink droplet to be ejected from the nozzle using the pressure of the bubble caused by film boiling.

Next, description will be given of the electrical configuration of the printer 11, with reference to FIG. 5. As illustrated in FIG. 5, a controller 50 which is provided in the printer 11 is provided with a power device 51, a computer 52 (a microcomputer), a display drive circuit 53, a head drive circuit 54, and motor drive circuits 55 to 57. The operation unit 15, a paper presence sensor 47, a paper detection sensor 48, a paper width sensor 49, a linear encoder 39, encoders 58 and 59, and the like are connected to the computer 52 as the input system. The display drive circuit 53, the head drive circuit 54, and the motor drive circuits 55 to 57 are connected to the computer 52 as the output system. Each of the drive circuits 53 to 57 is respectfully connected to the display unit 14, the print head 23, the carriage motor 35, the feed motor 41, and the transport motor 42.

The power device 51 illustrated in FIG. 5 receives an input, via the AC adapter 27, of a direct current of a predetermined voltage (a primary voltage) which is obtained by transforming, rectifying, or the like the alternating current voltage from the commercial power source 30, and boosts the input direct current to a predetermined voltage which is necessary for the driving of the motors 35, 41, and 42. The power device 51 supplies the boosted predetermined voltage to the motors 35, 41, and 42 via the motor drive circuits 55 to 57 using one system, boosts the voltage in the other systems to a plurality of types of predetermined voltage and supplies the predetermined voltages which are necessary for each of the print head 23, the display unit 14, the computer 52, and the input system such as the sensors.

The battery 28 which is stored in the apparatus main body 12 is electrically connected to the power device 51. The computer 52 detects the voltage of a predetermined location in the circuit of the power device 51, and includes a function of detecting the connection of the AC adapter 27 and the connection of the battery 28 based on the detected voltage. Therefore, the computer 52 is capable of recognizing whether the power of the power supply source at an arbitrary time is the AC adapter 27 (that is, the commercial power source 30) or the battery 28. The computer 52 sets the power supply mode of when the connection of the AC adapter 27 is detected as "the AC power mode", and the power supply mode of when the connection of the AC adapter 27 is not detected and the connection of the battery 28 is detected as "the battery mode".

The power which is supplied by the battery 28 is smaller than the power which is supplied via the AC adapter 27. Therefore, the power which is supplied from the battery 28 via the power device 51 during the battery mode is smaller than the power which is supplied from the AC adapter 27 via the power device 51 during the AC power mode. In the present embodiment, the AC adapter 27 which converts the alternating current which is input from the commercial power source 30 to a direct current corresponds to an example of an AC power unit. The AC power and the battery 28 each form an example of a power unit.

Due to the computer 52 outputting respective command values to each of the motor drive circuits 55 to 57, drive voltages corresponding to the command values are applied to the motors 35, 41, and 42. In the present example, a pulse width modulation (PWM) signal is output as the command value, and each of the motors 35, 41, and 42 is subjected to speed control due to a current corresponding to the duty cycle (the ratio of the pulse width to the period of the PWM signal) of the PWM signal flowing therethrough. The computer 52 controls the driving of each of the motors 35, 41, and 42 by outputting individual command values to the motor drive circuits 55 to 57. The carriage motor 35 rotates forward or backward according to a direction indication signal which is output to the motor drive circuit 55 by the computer 52.

The paper presence sensor 47 illustrated in FIG. 5 is an optical or contact sensor which is capable of detecting whether the paper P is present on the feed tray 16 (refer to FIG. 3). The paper detection sensor 48 detects the leading end of the paper P at a predetermined position on the feed path, and the position when the leading end is detected is used as a reference position during the measurement of the position (the transport position) of the paper P in the transport direction Y. The paper width sensor 49 detects the side end of the paper P by moving in the scanning direction X with the carriage 21 while irradiating a detection beam toward the paper P which is on the support stand 38. The width of the paper P or the printing start position (the ink ejection start position) of the print head 23 in the scanning direction X based on the detection signal of the paper width sensor 49.

The linear encoder 39 outputs a pulse signal with a number of pulses which is proportional to the rotation amount of the carriage motor 35. Each of the encoders 58 and 59 outputs a pulse signal with a number of pulses which is proportional to the rotation amount of the respective motor 41 or 42 of the feed or transport system. Each of the encoders 58 and 59 is formed of a rotary encoder which is connected to the drive shaft or the end portion of a rotating shaft of a motive force transmission system which transmits the rotation of the drive shaft of the corresponding motor 41 or 42.

As illustrated in FIG. 5, the computer 52 is provided with a CPU 61, an application specific integrated circuit (ASIC) 62, a RAM 63, and a non-volatile memory 64. The CPU 61 manages the various control of the print system, the operation system, the display system, and the like by executing a control program (for example, a firmware program) which is stored in the non-volatile memory 64. In particular, in the present embodiment, due to the CPU 61 executing the programs of the correction value setting process routine illustrated in FIG. 11 and the print control routine illustrated in FIG. 12 which are stored in the non-volatile memory 64, the speed control of the carriage motor 35 is performed according to whether a difference in the power unit of the power supply source to the power device 51 indicates the AC power mode or the battery mode. The print data, the computation results of the CPU 61, and the like are temporarily stored in the RAM 63.

As illustrated in FIG. 5, speed control data VD, test pattern data TD, and correction information CD are stored in the non-volatile memory 64. The speed control data VD is used when subjecting the carriage motor 35 to the speed control, the test pattern data TD is used when printing test patterns TP, TP1, and TP2 (refer to FIGS. 8, 10A and 10B) which are used when performing the Bi-D adjustment, and the correction information CD is acquired as a result of performing the Bi-D adjustment.

The computer 52 is connected to the display unit 14 via the display drive circuit 53. The computer 52 monitors the state of the printer 11 and for the presence of an operation of the operation unit 15, and causes the display unit 14 to display menus according to display events which occur, selection items of print conditions, various messages including warning messages, and the like via the display drive circuit 53.

The computer 52 is connected to the print head 23 via the head drive circuit 54.

The computer 52 outputs the print data which is received from a host device (not shown), or the print data (dot data) which is generated based on the image data which is loaded from a USB memory or a memory card to the head drive circuit 54, and causes ink droplets to be ejected from nozzles corresponding to the dots in the print data in the print head 23. Note that, examples of a host device include a smart phone, a mobile telephone, a tablet PC, portable terminal such as a Personal Digital Assistant (PDA), and a personal computer.

The computer 52 acquires a distance and a speed from the movement start position of the carriage 21 in the scanning direction X based on the pulse signal from the linear encoder 39, and sequentially acquires a target speed by referring to the speed control data VD of the carriage based on the distance. The computer 52 subjects the carriage motor 35 to speed control by sequentially outputting the command values which are obtained using a feedback control computation which causes the actual speed to approach the target speed to the motor drive circuit 55. Note that, the computer 52 acquires the distance and the actual speed from the movement start position of the paper P based on the pulse signals from the encoders 58 and 59, and outputs each of the command values to the respective motor drive circuit 56 or 57, where the command values are obtained using a feedback control computation which causes the actual speed to approach the target speed based on the speed control data for the motors 41 and 42. Accordingly, the motors 41 and 42 of the feed and transport systems are subjected to speed control.

Next, description will be given of the speed profile of the carriage 21 when the carriage motor 35 is subjected to speed control based on the speed control data VD, with reference to FIG. 4. In the graph illustrated in FIG. 4, the horizontal axis is a distance D (a position) which the carriage 21 is moved from the start of driving, and the vertical axis is a speed Vcr of the carriage 21. The distance D is provided by a count value of a counter which counts the pulse edge of the output pulse of the linear encoder 39, for example. The speed profile is formed of an acceleration region (an acceleration profile), a fixed speed region, and a deceleration region (a deceleration profile). The acceleration region spans from when the carriage speed Vcr is 0 to an acceleration complete position Da at which fixed speeds V1 and V2 are reached, in the fixed speed region, the carriage speed Vcr is maintained at the fixed speeds V1 and V2, and in the deceleration region, the carriage speed Vcr is caused to decelerate from a deceleration start position Dd until stopping at a target position De. Note that, the carriage speed Vcr is in a proportional relationship with the rotational speed of the carriage motor 35 according to the gear ratio of the gear train which is interposed between the carriage 21 and the carriage motor 35.

Figure 4:
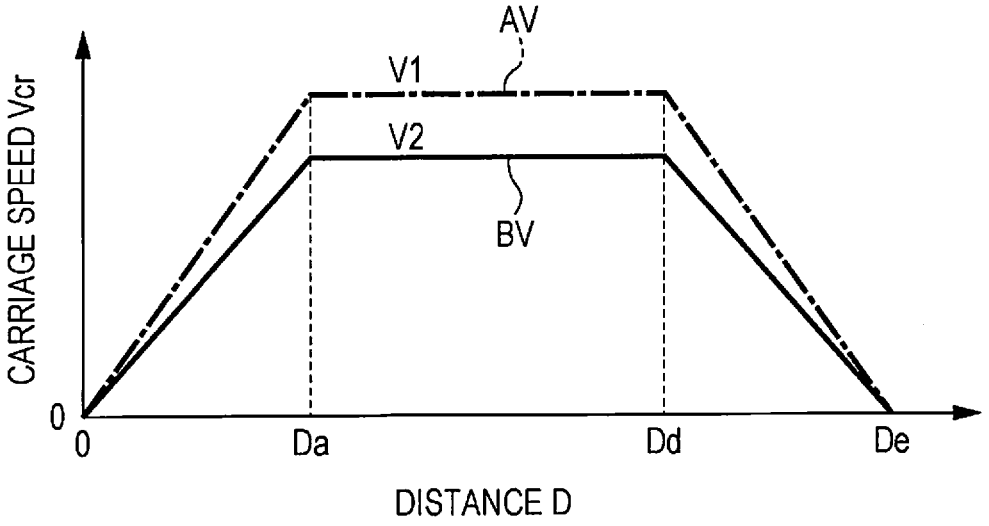
FIG. 4 is a graph illustrating speed control of a carriage motor for each power supply mode.

As illustrated in FIG. 4, a different speed profile is set for each of the fixed speeds V1 and V2 for each power supply mode. For example, the fixed speed V1 of an AC power mode speed profile AV (the dot-and-dash line) is set to a be faster than the fixed speed V2 of the battery mode speed profile BV (the solid line). This is caused by the power which is supplied by the battery 28 being smaller than the power which is supplied by the AC power unit. Therefore, the fixed speed V2 of the battery mode is suppressed to a lower speed than the fixed speed V1 of the AC power mode, and therefore, the power consumption of the motors 35, 41, and 42 during the battery mode is suppressed to a smaller level.

Here, in FIG. 4, the ejection of the ink from the nozzles 23*b* of the print head 23 is performed in the fixed speed region in which the carriage 21 is the fixed speed V1 or V2. A configuration may be adopted in which the ejection of the ink is performed across a portion of the acceleration region and a portion of the deceleration region, at both sides of the fixed speed region. In either case, since the ejection timing of the ink of the print head 23 is proportional to the pulse period of the input pulse per unit time which the computer 52 inputs from the linear encoder 39, the ink droplets are ejected at a fixed pitch in the scanning direction X.

The computer 52 acquires the target speed by referring to the speed control data VD based on the distance D indicated by the count value of the CR counter. The computer 52 performs the feedback control computation in which the actual speed which is determined from the number of pulse edges per unit time input from the linear encoder 39 it caused to approach the target speed, and acquired the command value for subjecting the carriage motor 35 to speed control. Due to the command value from the computer 52 being output to the motor drive circuit 55, the carriage motor 35 is subjected to speed control along the speed profiles illustrated in FIG. 4. The motor drive circuit 55 is provided with a switching circuit, for example, and the carriage motor 35 is subjected to speed control due to switching elements in the switching circuit being turned on and off based on the PWM signal according to the command value.

In the present embodiment, in the AC power mode, CR•PF overlap control is adopted in which the carriage motor 35 of the scanning system and the transport motor 42 are driven such that the drive periods thereof partially overlap. For example, when the ink ejection process ends during the movement of the carriage 21 which is driven by the carriage motor 35, at approximately the same time, the driving of the transport motor 42 is started to start the transportation of the paper P. The transportation of the paper P is started before the carriage 21 stops due to the overlap control. The movement of the carriage 21 is started while the paper P is being transported such that it is possible to start the ejection of the ink from the print head 23 at approximately the same time as the stopping of the paper P which is being transported. Accordingly, a portion of the driving period of the transport motor 42 and at least a portion of the acceleration period of the carriage motor 35 before the ejection of the ink is started. According to the overlap control, the movement of the carriage 21 is started before the transportation of the paper P stops. Accordingly, according to the CR•PF overlap control, it is possible to start the printing of the next pass of the carriage 21 early, and it is possible to start the transportation of the paper P.

Since it is necessary to transfer the paper P which is fed by a feed roller (not shown) to the transport roller pair 43 when feeding the paper P in both the AC power mode and the battery mode, the feed motor 41 and the transport motor 42 are driven such that the drive times thereof partially overlap each other. In only the AC power mode, a CR•ASF overlap control is performed in which the three motors 35, 41, and 42 are driven at the same time due to the driving of the carriage motor 35 being started before the paper P which is fed reaches the printing start position and the driving of the motors 41 and 42 stops. According to the overlap control, the movement of the carriage 21 starts before the paper P reaches the printing start position, and the ejection of the ink droplets onto the paper P from the print head 23 starts at approximately the same time as the paper stops at the printing start position; thus, it is possible to start the printing of the first pass early.

When the CR•ASF overlap control in which the drive periods of the plurality of motors 35 and 41 are caused to partially overlap, and the CR•PF overlap control in which the drive periods of the plurality of motors 35 and 42 are caused to partially overlap are performed, the power consumption of the printer 11 increases. Therefore, the overlap controls are performed during the AC power mode, but are not performed during the battery mode which has a relatively small power consumption. During the battery mode, the carriage motor 35 and the transport motor 42 are controlled such that the driving of one of the motors 35 and 42 is stopped, and subsequently, the driving of the other is started.

Figure 6:
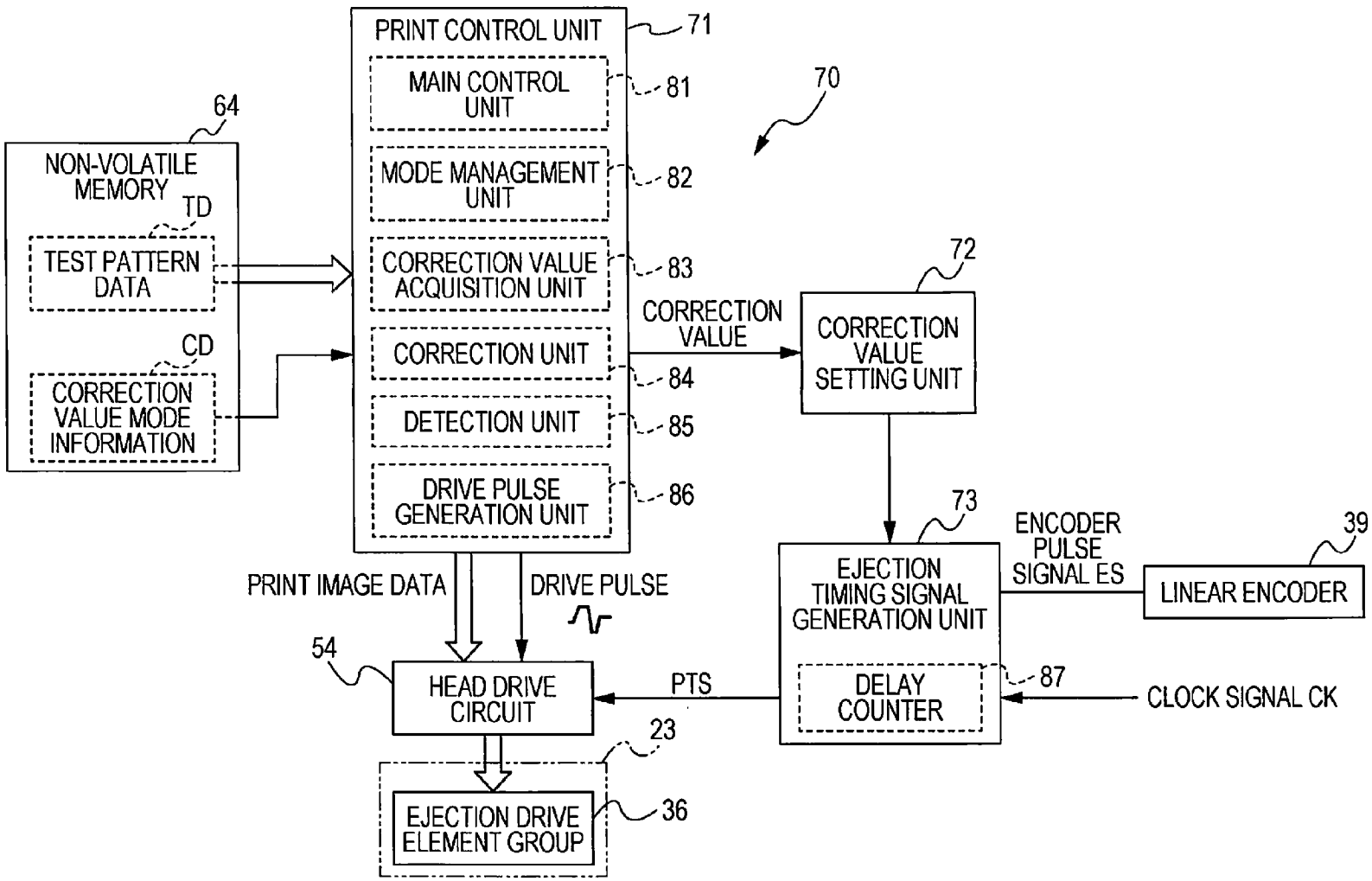
FIG. 6 is a block diagram illustrating the functional configuration of a computer.

Next, the configuration of an ejection control device 70 which is constructed within the computer 52 and controls the ejection timing of the ink is illustrated with reference to FIG. 6. As illustrated in FIG. 6, the ejection control device 70 is provided with a print control unit 71, the non-volatile memory 64, a correction value setting unit 72, an ejection timing signal generation unit 73, the head drive circuit 54, the ejection drive element group 36, and the like.

The print control unit 71 is provided with a main control unit 81, a mode management unit 82, and a correction value acquisition unit 83. The main control unit 81 performs the overall management of various control of the print system, the operation system, the display system, and the like of the printer 11, the mode management unit 82 manages the present power supply mode and printing mode of the printer 11, and the correction value acquisition unit 83 performs the Bi-D adjustment including the printing of the test pattern TP for acquiring the correction value. The print control unit 71 is provided with a correction unit 84 and a detection unit 85. The correction unit 84 acquires the correction value corresponding to the power supply mode (that is, the speed mode) at that time based on the correction information CD (FIGS. 5, 9A, and 9B) which is stored in the non-volatile memory 64, and the detection unit 85 detects that the power supply source switches between the AC power unit and the battery. The print control unit 71 is provided with a drive pulse generation unit 86 which generates a drive pulse which is applied when causing the ejection drive element 46 to eject the ink. The print data which is received from an external host device by the printer 11 or the print data which is read from a USB memory or a memory card by the printer 11 is input to the print control unit 71.

In the correction value setting unit 72, the correction value which is acquired by the correction unit 84 is set by the print control unit 71. For example, a register (not shown) is embedded in the correction value setting unit 72, and the correction value is set due to the print control unit 71 storing the correction value in the register.

The ejection timing signal generation unit 73 receives the input of an encoder pulse signal ES and a clock signal CK from the linear encoder 39, inputs the correction value from the correction value setting unit 72, and generates an ejection timing signal PTS which determined the ink ejection timing of the print head 23 at a timing according to the correction value. The ejection timing signal generation unit 73 is provided with a first signal generation unit (not shown), and a second signal generation unit (not shown). The first signal generation unit generates a reference pulse SP1 (refer to FIGS. 7A and 7B) with a pulse period which is sufficiently shorter than the encoder pulse signal ES based on the encoder pulse signal which is input from the linear encoder 39, and the second signal generation unit generates a counting pulse SP2 (refer to FIGS. 7A and 7B) with a pulse period which is sufficiently shorter than the reference pulse SP1. The ejection timing signal generation unit 73 is provided with a delay counter 87 which inputs the reference pulse SP1 and the counting pulse SP2. The correction value (the delay count value) from the correction value setting unit 72 is set as the target value in the delay counter 87. The delay counter 87 includes a function of outputting the ejection timing signal PTS to the head drive circuit 54 when the reference pulse is used as a trigger, the counting of the counting pulse is started, and the count value reaches the correction value which is the target value. Accordingly, the ejection timing signal generation unit 73 outputs the ejection timing signal PTS at a timing which is delayed in relation to the reference pulse by a distance according to the correction value which is set in the correction value setting unit 72.

Hereinafter, detailed description will be given of the functional components described above.

The main control unit 81 controls the operation system such as the operation unit 15, the detection system such as the sensors 47 to 49, the power supply system such as the power device 51, the display system such as the display unit 14, and the drive system such as the print head 23, the carriage motor 35, the feed motor 41, and the transport motor 42. The main control unit 81 includes a function of controlling the motors 35, 41, and 42 using the various commands which are acquired from the print data, subjecting the print image data (raster data) which is acquired from the print data to a predetermined process such as converting the print image data into a format which can be controlled by the print head 23, and subsequently outputting the print image data after the processing to the head drive circuit 54.

The mode management unit 82 detects the voltage of a predetermined location in the circuit of the power device 51, determines the present power supply source (the power unit) based on the detected voltage, and determined the present power supply mode. When the power supply source which is determined is the AC power unit, the AC power mode is set, and when the power supply source is the battery 28, the battery mode is set. In the present embodiment, since the battery 28 with a smaller supply of power than the supply of power of the AC power unit, the AC power mode is set to a high speed mode and the battery mode is set to a low speed mode. The mode management unit 82 manages the printing mode based on the print condition information in the print data or the print condition information which is input into and set by the print control unit 71 by the operation of the operation unit 15, and manages whether the printing mode is an ordinary printing mode or a high quality printing mode, for example. As described earlier, in the present embodiment, when the ordinary printing mode is selected, the bidirectional printing is selected, and when the high quality printing mode is selected, the unidirectional printing is selected. Note that, which printing mode to set to the bidirectional printing can be modified as appropriate.

The print control unit 71 subjects the carriage motor 35 to speed control according to the power supply mode and the printing mode managed by the mode management unit 82 at the time. The print control unit 71 transmits the print image data and the commands which are necessary for the ejection control in which the ink is ejected from the nozzles 23*b* of the print head 23 to the head drive circuit 54, for each unit of one pass (a raster line).

When the power switches between the AC power unit and the battery during the printing, the print control unit 71 performs print control according to the switching. For example, when the power switches from the AC power unit to the battery during the printing, the print operation is stopped right away and the paper P is output. At this time, the carriage stops the ink ejection of the print head 23 and moves to the home position HP. Meanwhile, when the power switches from the battery to the AC power unit during the printing, for example, the pass (one scan) of the time of the switching maintains the speed mode of the time of the battery mode and ends the printing of the one pass at the time, and from the next pass (one scan), the speed mode of the carriage motor 35 is switched to the high speed mode during the AC printing mode.

The print control unit 71 acquires the target speed by referring to the speed control data VD based on the distance D indicated by the count value of each counter, and acquires the command value (for example, the PWM command value) by performing the feedback control computation in which the detected speed (the actual speed) is caused to approach the target speed. By outputting the command values to the respective motor drive circuits 55 to 57, the print control unit 71 subjects the motors 35, 41, and 42 to speed control using a speed profile according to the mode at the time. Note that, instead of feedback control, feed forward control may be performed in which a command value which is determined from a period CT according to the distance D.

During the printing in the AC power mode, the detection unit 85 detects the cutting out of the supply of power from the AC power source when the plug is removed from the electrical outlet, the power source is cut out due to a power cut, or the like.

In this case, the detection unit 85 detects the switching from the AC power mode to the battery mode. When the power supply mode switches from the AC printing mode to the battery mode, if the printing is underway, for example, when the CR•PF overlap control is being performed, there is a concern that a system crash will occur from insufficient power.

Therefore, when the detection unit 85 detects the switching from the AC power mode to the battery mode during the printing, the main control unit 81 causes the print operation to stop right away. In this case, when the carriage 21 is moving, either the printing is stopped part way through a pass, or the printing is stopped, the carriage 21 moves to the home position HP at the low speed during the battery mode and waits in a state of the print head 23 being capped by the cap 45*a*.

Conversely, when printing in battery mode, when the plug is plugged into the electrical outlet and the detection unit 85 detects the supply of power due to the plugging in, the power supply mode switches from the battery mode to the AC power mode. When the carriage 21 is moving part way through a pass at this time, when the carriage speed switches from the low speed which continues until this point to the high speed, the interval of the ink dots is not fixed in the acceleration process, and the print quality is reduced. Therefore, until the pass at the time is ended, the carriage 21 continues at the speed of the battery mode, and switches to the control which is used during the AC power mode from the next pass.

The drive pulse generation unit 86 generates a drive pulse including a plurality of (for example, two or three) types of ejection waveform for each ejection period (one period) in which one dot is ejected from the nozzle 23*b*, and outputs the generated drive pulse to the head drive circuit 54. The print head 23 of the present embodiment is capable of ejecting ink droplets of a plurality of sizes, and, for example, is capable of ejecting three types of ink droplet, large, medium, and small. The head drive circuit 54 selects one type or two types of waveform from the input drive pulse, and the size of the ink droplet is determined by a voltage pulse of the selected ejection waveform being applied to the ejection drive element 46 in the ejection drive element group 36.

The head drive circuit 54 selects at least at least one of a plurality of ejection waveforms in the drive pulse which is input for each ejection period according to a gradation value based on the print image data (the gradation value data) which is input, and applies the voltage pulse of the selected ejection waveform at a timing based on the ejection timing signal PTS to the ejection drive element group 36. As a result, the ejection waveform pulse (the voltage pulse) is applied to, within the ejection drive element group 36, the ejection drive element 46 corresponding to the nozzle 23*b* which forms the pixel, and the ink droplet is ejected from the nozzle 23*b* due to, for example, the electrostriction effect of the ejection drive element 46 causing the ink chamber to expand and contract. The gradation value data is data which represents the gradation value in two bits, for example, and when the gradation value is "00", there is no ejection, when the gradation value is "01", the ink droplet of a small dot is ejected, when the gradation value is "10", the ink droplet of a medium dot is ejected, and when the gradation value is "11", the ink droplet of a large dot is ejected.

The bidirectional printing of the present embodiment is an ejection mode in which the ejection waveforms in a case in which the ink droplets are ejected from the nozzles 23*b* of the print head 23 are the same between a plurality of power supply modes with different carriage speeds (that is, print head speeds). Specifically, the ink droplets are ejected at one type of size in all of the power supply modes in the bidirectional printing. Therefore, the ejection waveform pulses which are applied to the ejection drive elements 46 of the print head 23 are the same between the AC printing mode and the battery mode, and the ejection speed of the ink droplets which are ejected from the nozzles 23*b* of the print head 23 are the same. In the bidirectional printing, the gap between the support stand 38 and the nozzle opening surface 23*a* of the print head 23 is the same in all of the power supply modes. In addition to the carriage speed, the correction value of the Bi-D adjustment is affected by the ejection speed and the gap of the print head 23; however, in the present embodiment, since the ejection speed (the ejection mode) and the gap are the same, it is possible to obtain the correction value of the other power supply modes by calculating using the correction value which is acquired in one Bi-D adjustment of the plurality of power supply modes with different carriage speeds. Note that, a configuration may be adopted in which the gradation value of the print data is set to two grades, and the print head 23 may only eject ink droplets of one type of size.

Next, description will be given of the Bi-D adjustment, with reference to FIGS. 7A and 7B.

In the Bi-D adjustment, a correction value which is used for adjusting the ejection timing according to the carriage speed (that is, the print head speed) is set. Note that, in FIGS. 7A and 7B, the movement toward the left direction is an outward path, and the movement toward the right direction is a return path. As illustrated in FIGS. 7A and 7B, it is necessary to cause a landing position DP (a printing position) of an ink droplet 65 which is ejected from the nozzle 23*b* of the print head 23 in the outward path of the carriage 21 to match the landing position DP (the printing position) of the ink droplet 65 which is ejected from the nozzle 23*b* of the print head 23 in the return path of the carriage 21.

Figure 7A:
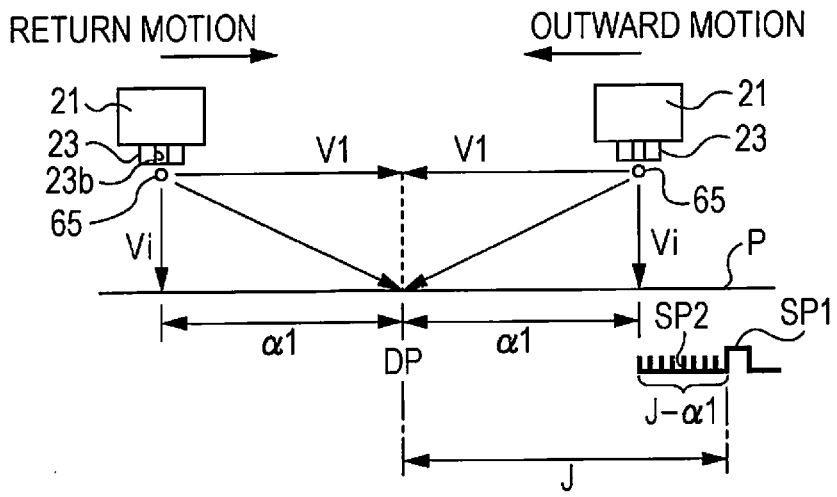
FIG. 7A is a schematic front view illustrating a Bi-D adjustment during an AC power mode.

As illustrated in FIG. 7A, when the carriage 21 performs the outward motion at the high speed V1, a relatively large shift amount $\alpha 1$ is generated in the scanning direction X between the ejection start position, which is the position of the carriage 21 in FIG. 7A, and the landing position DP. Therefore, it is necessary to set the ejection start position at a timing which is earlier by the shift amount $\alpha 1$ in the outward motion direction. As illustrated in FIG. 7A, even when the carriage 21 performs the return motion at the high speed V1, similarly, it is necessary to set the ejection start position at a timing which is earlier by the shift amount $\alpha 1$ in the return motion direction.

Figure 7B:
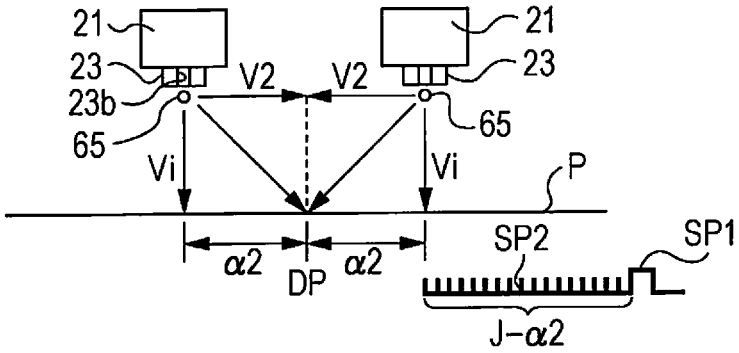
FIG. 7B is a schematic front view illustrating the Bi-D adjustment during a battery mode.

As illustrated in FIG. 7B, when the carriage 21 performs the outward motion at the low speed V2, a relatively small shift amount $\alpha 2$, in comparison to the shift amount $\alpha 1$, is generated in the scanning direction X between the ejection start position, which is the position of the carriage 21 in FIG. 7B, and the landing position DP. Therefore, it is necessary to set the ejection start position at a timing which is earlier by the shift amount $\alpha 2$ in the outward motion direction. As illustrated in FIG. 7B, even when the carriage 21 performs the return motion at the low speed V2, similarly, it is necessary to set the ejection start position at a timing which is earlier by the shift amount $\alpha 2$ in the return motion direction.

When performing the Bi-D adjustment, the user selects the maintenance item from the menu screen of the display unit 14 and selects the Bi-D adjustment item from the maintenance items by operating the operation unit 15. The user instructs the printing of the test pattern TP (refer to FIG. 8) by operating the operation unit 15 in a state in which the paper P is set. The instruction is received by the print control unit 71 of the computer 52, and the print control unit 71 instructs the correction value acquisition unit 83 to print the test pattern TP. The correction value acquisition unit 83 acquires the correction information CD and acquires the correction value according to the power supply mode of the time at which the mode management unit 82 manages the power supply mode. Using a plurality of correction values centered on the correction value in which the correction value is shifted sequentially for each predetermined shift amount, the test pattern TP which includes a plurality of inspection patterns, sequentially changing between the respective correction values, is printed. An example of the printed test pattern TP is illustrated in FIG. 8.

Figure 8:
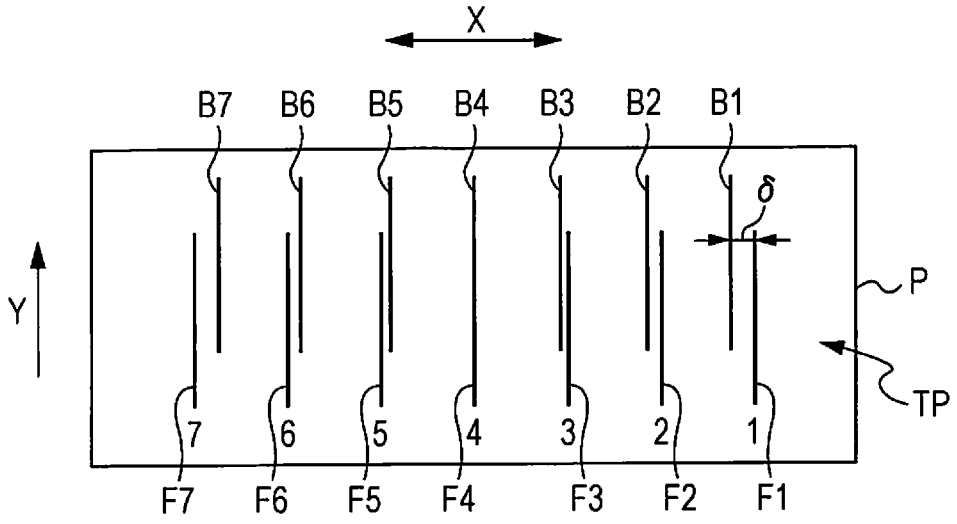
FIG. 8 is a schematic diagram illustrating a test pattern which is printed during the Bi-D adjustment.

As illustrated in FIG. 8, the test pattern TP is obtained by printing a plurality of (in the present embodiment, 7) ruled line pairs RP as inspection patterns by printing a plurality of ruled lines B1 to B7, which are straight lines extending in the transport direction Y, during the outward motion of the print head 23, and printing the same number of ruled lines F1 to F7 during the return motion as are printed the ruled lines B1 to B7 during the outward motion. Each of the ruled line pairs RP is a pair formed of one of the ruled lines B1 to B7 which are printed by the print head 23 during the outward motion and one of the ruled lines F1 to F7 which are printed during the return motion, and each of the ruled line pairs RP is formed at a different ejection timing with a different shift amount $\delta$ between the ruled lines of the pair. In the test pattern TP, a number from 1 to 7 corresponding to each of the ruled line pairs RP is printed in a position on the downstream side of the ruled line pair RP in the transport direction Y.

Specifically, when the print control unit 71 causes the carriage 21 to perform the outward motion along the scanning direction X by driving the carriage motor 35, the ruled lines B1 to B7 are printed by ejecting the ink droplets 65 from the nozzles 23*b* corresponding to a predetermined color onto the paper P by sequentially changing the ejection timing according to the plurality of correction values. When the print control unit 71 causes the carriage 21 to perform the return motion along the scanning direction X, the ruled lines F1 to F7 are printed by ejecting the ink droplets 65 from the nozzles 23*b* corresponding to a predetermined color onto the paper P by sequentially changing the ejection timing according to the plurality of correction values. As a result, the test pattern TP which contains the plurality of ruled line pairs RP for the Bi-D adjustment is printed.

Since the correction values $\alpha 1$ and $\alpha 2$ for the Bi-D adjustment rely on the carriage speed Vcr, in the related art, the Bi-D adjustment is performed for each speed mode corresponding to each of the speeds V1 and V2; however, in the present embodiment, the Bi-D adjustment is performed in only one speed mode of the plurality of speed modes, and only one of the correction values is set. Therefore, a configuration is adopted in which the other correction values are acquired by performing a calculation using the one adjustment value which is acquired using the Bi-D adjustment without performing the Bi-D adjustment in the other speed modes.

The initial correction value is acquired in an inspection process in the manufacture process of the printer, for example. First, the test pattern TP is printed onto the paper P by performing the bidirectional printing at a predetermined carriage speed. The number corresponding to the smallest shift amount δ of the printing between the outward path and the return path among the plurality of inspection patterns (the ruled line pairs RP) from the printed result of the test pattern TP is set by being input to the printer 11 by the operation of the operation unit 15. Therefore, the correction value acquisition unit 83 of the computer 52 stores the correction information CD in a predetermined storage region of then non-volatile memory 64, the correction information CD containing the correction value corresponding to the number which is set by input and the information (hereinafter, referred to as "the power supply mode information") relating to the power supply mode when the test pattern TP is printed.

For example, when performing the Bi-D adjustment in the AC power mode, the correction value acquisition unit 83 causes the carriage 21 to move at the fixed speed V1 (>V2) illustrated in FIG. 7A in the high speed mode corresponding to the AC power mode, and the test pattern TP illustrated in FIG. 8 is printed onto the paper P. At this time, the correction value acquisition unit 83 acquires the correction value α1 using the correction information CD of the non-volatile memory 64, and, using a plurality of correction values centered on the correction value α1 in which the value is shifted sequentially for each of the predetermined shift amounts, the test pattern TP is formed by printing a plurality of inspection patterns, sequentially changing between the respective correction values.

The user visually determines and selects the inspection pattern with the smallest shift amount δ from among the plurality of inspection patterns (the ruled line pairs RP) which form the test pattern TP, and sets the number corresponding to the selected inspection pattern by input using the operation of the operation unit 15. In the example of FIG. 8, when the number "4" which corresponds to the inspection pattern with the smallest shift amount δ is selected and the number "4" is input by the operation of the operation unit 15, and the number "4" is stored in a predetermined storage region of the non-volatile memory 64 together with power supply mode information indicating that the correction value corresponding to the number is the "AC power mode" of that time. At this time, since the number "4" indicates that there is no change in the correction value, a value which is the same as the correction value which is used during the printing of the test pattern TP is stored as the correction value. When the number which corresponds to the inspection pattern with the smallest shift amount δ is a number other than "4", the correction value is changed to the correction value which corresponds to the number other than "4" and is stored in the predetermined storage region of the non-volatile memory 64.

Meanwhile, when performing the Bi-D adjustment in the battery mode, for example, the correction value acquisition unit 83 causes the carriage 21 to move at the fixed speed V2 (<V1) illustrated in FIG. 7B in the low speed mode corresponding to the battery mode, and the test pattern TP illustrated in FIG. 8 is printed onto the paper P. At this time, the correction value acquisition unit 83 acquires the correction value α2 using the correction information CD of the non-volatile memory 64, and, using a plurality of correction values centered on the correction value α2 in which the value is shifted sequentially for each of the predetermined shift amounts, the test pattern TP is formed by printing a plurality of inspection patterns, sequentially changing between the respective correction values. The user visually determines and selects the inspection pattern with the smallest shift amount δ from among the plurality of inspection patterns (the ruled line pairs RP) which form the test pattern TP, and sets the number corresponding to the selected inspection pattern by input using the operation of the operation unit 15. The correction value acquisition unit 83 causes the number to be stored in the predetermined storage region of the non-volatile memory 64 together with the power supply mode information indicating that the correction value corresponding to the number is the "battery mode".

Here, in the present example, the correction value which is acquired from the input of the number with the smallest shift amount δ from the printed result of the test pattern TP which is printed after performing the Bi-D adjustment corresponds to an example of a first correction value. The correction value which is obtained using a calculation using the first correction value corresponds to an example of a second correction value. Specifically, when the Bi-D adjustment is performed in the AC power mode, the first correction value α1 corresponds to an example of the first correction value, and the second correction value α2 which is obtained by a calculation using the first correction value α1 corresponds to an example of the second correction value. When the Bi-D adjustment is performed in the battery mode, the second correction value α2 corresponds to an example of the first correction value, and the first correction value α1 which is obtained by a calculation using the second correction value α2 corresponds to an example of the second correction value.

Next, description will be given of the correction information CD relating to the Bi-D adjustment which is saved in the predetermined storage region of the non-volatile memory 64, with reference to FIGS. 9A and 9B. The correction information CD contains the power supply mode information indicating the power supply mode when the test pattern TP is printed in the Bi-D adjustment and the correction value which is acquired by the correction value acquisition unit 83 and corresponds to the number which is input from the operation unit 15. If the power supply mode which is managed by the mode management unit 82 when the user instructs the Bi-D adjustment is the "AC power mode", for example, the test pattern TP is printed in the high speed mode. In other words, as illustrated in FIG. 9A, when the Bi-D adjustment is carried out in the AC printing mode, the number which is selected by the user is input, where the user views the printed result of the test pattern TP which is printed by the print head 23 which moves in the fixed speed region together with the carriage 21 at the high speed V1. The correction information CD which contains the first correction value α1 corresponding to the input number and the information indicating that the power supply mode when the test pattern TP is printed is the AC power mode is stored in the predetermined storage region of the non-volatile memory 64.

At this time, in order to acquire the second correction value α2 during the battery mode, the correction unit 84 multiplies the first correction value α1 by a correction coefficient K1, and performs the calculation using the equation $\alpha2=\alpha1\times K1$. The correction coefficient K1 is a positive value of less than 1 ($0<K1<1$). Here, $\alpha1$ is a value obtained by converting the distance from the ejection start position to the landing position DP in FIG. 7A to the count value of the delay counter 87. A value ($J-\alpha1$) obtained by subtracting the correction value $\alpha1$ from a set value J which corresponds to the distance calculated from the count value from the position of the print head 23 when the reference pulse SP1 is generated to the landing position DP is set in the delay counter 87 as the delay value.

Meanwhile, if the power supply mode which is managed by the mode management unit 82 when the user instructs the Bi-D adjustment is the "battery mode", for example, the test pattern TP is printed in the low speed mode. In other words, as illustrated in FIG. 9B, when the Bi-D adjustment is carried out in the battery mode, the number which is selected by the user is input, where the user views the printed result of the test pattern TP which is printed by the print head 23 which moves in the fixed speed region together with the carriage 21 at the low speed V2. The correction information CD which contains the second correction value $\alpha2$ corresponding to the input number and the information indicating that the power supply mode when the test pattern TP is printed is the battery mode is stored in the predetermined storage region of the non-volatile memory 64.

At this time, in order to acquire the first correction value $\alpha1$ during the AC power mode, the correction unit 84 multiplies the second correction value $\alpha2$ by a correction coefficient K2, and performs the calculation using the equation $\alpha1=\alpha2\times K2$. The correction coefficient K2 is a value greater than 1 ($K2>1$). Here, $\alpha2$ is a value obtained by converting the distance from the ejection start position to the landing position DP in FIG. 7B to the count value of the delay counter 87. A value ($J-\alpha2$) obtained by subtracting the correction value $\alpha2$ from the set value J which corresponds to the distance calculated from the count value from the position of the print head 23 when the reference pulse SP1 is generated to the landing position DP is set in the delay counter 87 as the delay value. Note that, one power supply mode worth of correction information CD corresponding to one of the plurality of power supply modes may be stored in the non-volatile memory 64, and a smaller memory capacity necessary for the storage of the correction information CD is sufficient in comparison with a configuration in which the correction value is stored for every power supply mode. Note that, in the present embodiment, the correction coefficients K1 and K2 are examples of a coefficient, and examples of numerical constants.

Next, description will be given of the operations of the printer 11.

Figure 11:
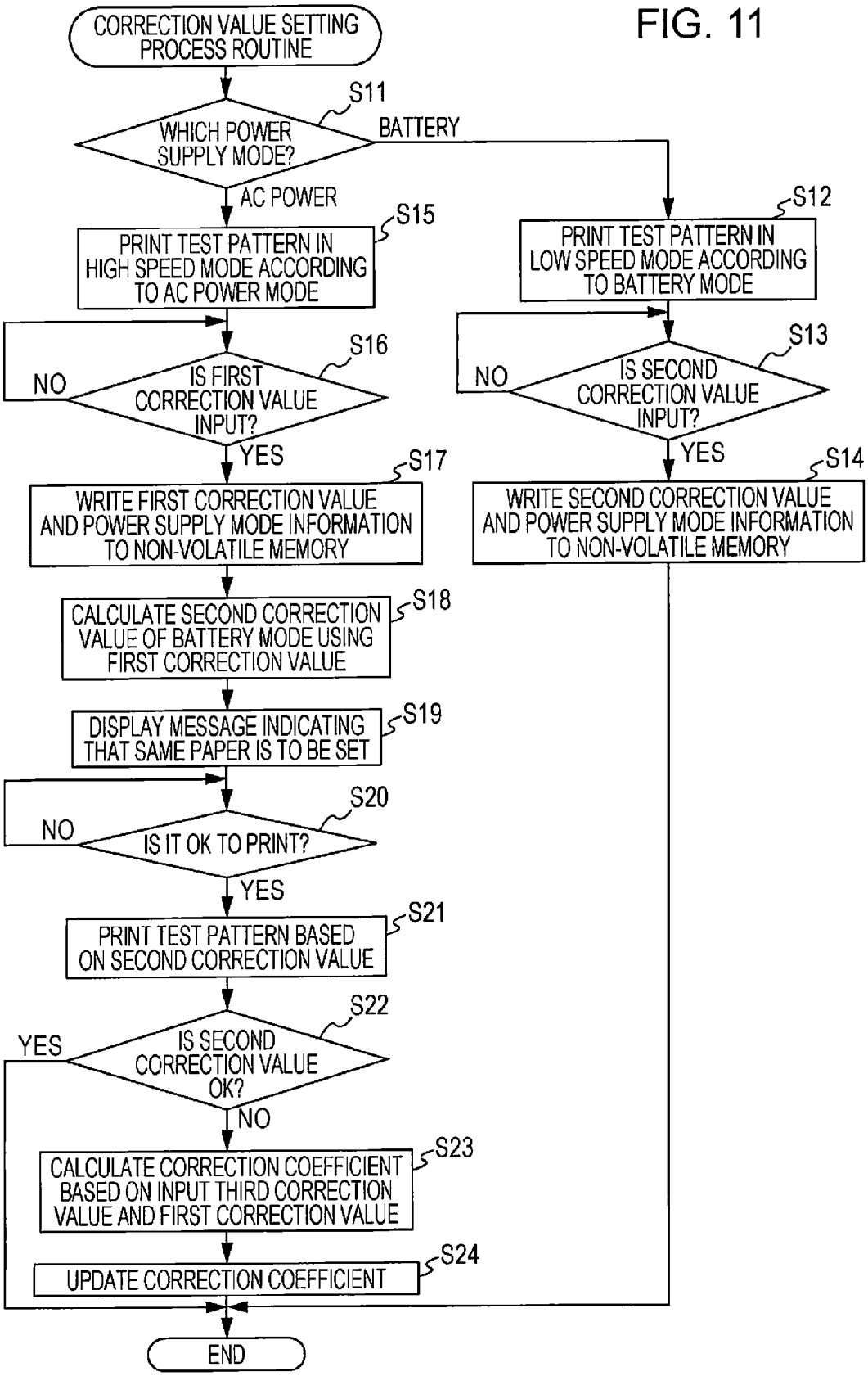
FIG. 11 is a flowchart illustrating a correction value setting process routine.
Figure 12:
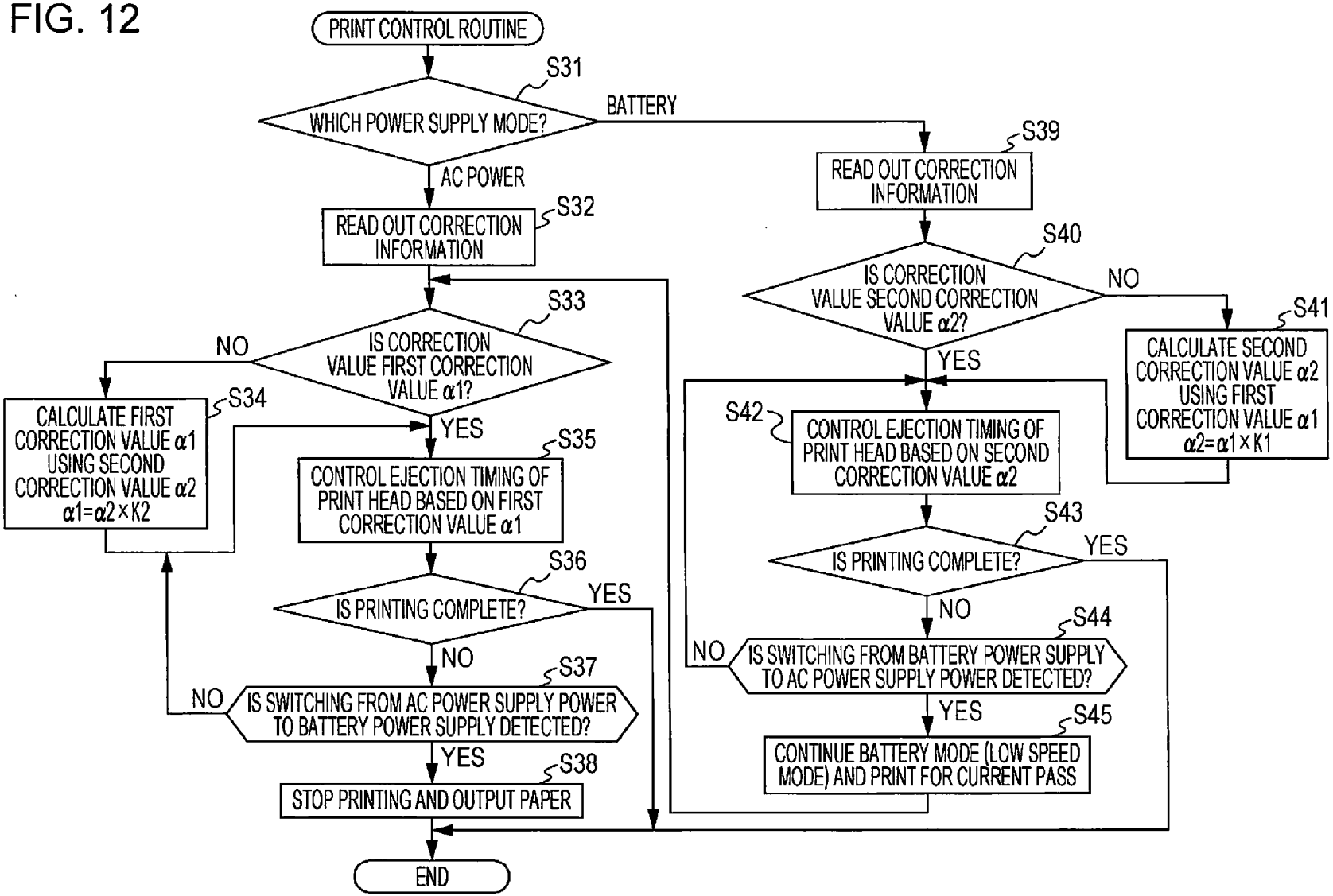
FIG. 12 is a flowchart illustrating a print control routine.

Hereinafter, description will be given of the correction value setting process which is carried out using the Bi-D adjustment in which the computer 52 executes the program illustrated in the flowchart of FIG. 11, with reference to FIG. 11. The correction value setting process is executed by the computer 52 when the bidirectional printing is performed. For example, when the user instructs the printing in an ordinary printing mode, since the bidirectional printing is instructed, the computer 52 executes the program illustrated in FIG. 11.

First, in step S11, the power supply mode is determined. In other words, it is determined whether the power supply mode is the battery mode or the AC power mode. If the power supply mode is the battery mode, the process proceeds to step S12, and if the power supply mode is the AC power mode, the process proceeds to step S15.

In step S12, the test pattern is printed in the low speed mode according to the battery mode is printed. In other words, the correction value acquisition unit 83 of the computer 52 acquires the second correction value $\alpha2$ corresponding to the battery mode by reading out the test pattern data TD from the non-volatile memory 64, and sequentially sets a plurality of correction values centered on the second correction value $\alpha2$ in which the correction value is shifted for each predetermined shift amount in the correction value setting unit 72 while the carriage 21 prints one pass. By printing each of the plurality of inspection patterns in order, the test pattern TP1 illustrated in FIG. 10A is printed onto the paper P, for example.

In step S13, it is determined whether or not the second correction value is input. In other words, since the user views the test pattern TP1 illustrated in FIG. 10A and inputs the number which corresponds to the inspection pattern with the smallest shift amount $\delta$ of the printing by operating the operation unit 15, and it is determined whether or not there is an input of a number from which it is possible to identify the second correction value from the operation unit 15. If there is no input of a number which can identify the second correction value, the process waits as it is until there is such an input, and proceeds to step S14 if there is an input of the number.

In step S14, the second correction value and the power supply mode information are written to the non-volatile memory.

Figure 10A:
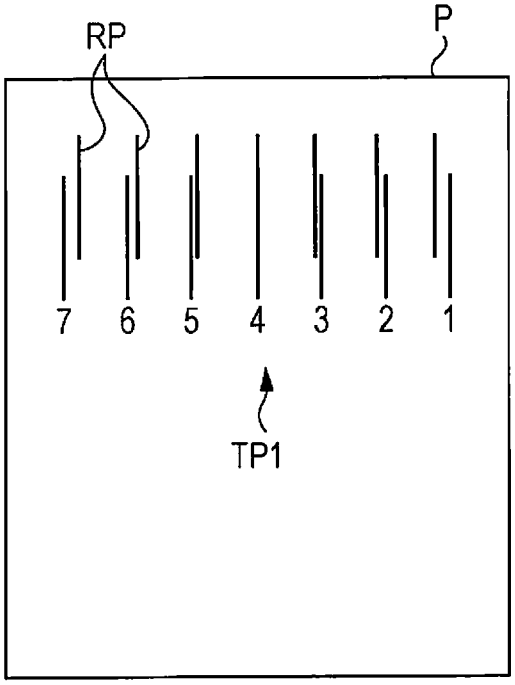
FIGS. 10A and 10B are schematic diagrams of test patterns during the Bi-D adjustment.

For example, if the number is input from the operation unit 15 in the example of FIG. 10A, the second correction value $\alpha2$ corresponding to the number and the information indicating that the power supply mode when the test pattern TP1 is printed is the battery mode are stored in the predetermined storage region of the non-volatile memory 64. The capacity of the predetermined storage region at this time is a capacity which is capable of storing the single second correction value $\alpha2$ which is obtained at that time, and the power supply mode information thereof. In this manner, the Bi-D adjustment during the battery mode is performed.

In step S15, the test pattern is printed in the speed mode according to the AC power mode is printed. In other words, the correction value acquisition unit 83 of the computer 52 reads out the test pattern data TD from the non-volatile memory 64 and acquires the first correction value $\alpha1$ corresponding to the AC power mode, and sequentially sets a plurality of correction values centered on the first correction value $\alpha1$ in which the correction value is shifted for each predetermined shift amount in the correction value setting unit 72 while the carriage 21 prints one pass. By printing each of the plurality of inspection patterns (the ruled line pairs RP) in order, the test pattern TP1 illustrated in FIG. 10A is printed onto the paper P, for example.

In step S16, it is determined whether or not the first correction value is input. In other words, since the user views the test pattern TP1 illustrated in FIG. 10A and inputs the number which corresponds to the inspection pattern with the smallest shift amount $\delta$ of the printing by operating the operation unit 15, and it is determined whether or not there is an input of a number from which it is possible to identify the first correction value from the operation unit 15. If there is no input of a number which can identify the first correction value, the process waits as it is until there is such an input, and proceeds to step S17 if there is an input of the number.

In step S17, the first correction value and the speed mode information are written to the non-volatile memory.

For example, if the number is input from the operation unit 15 in the example of FIG. 10A, the first correction value $\alpha 1$ corresponding to the number and the power supply mode information indicating that the power supply mode when the test pattern TP1 is printed is the AC power mode are stored in the predetermined storage region of the non-volatile memory 64.

In this manner, the Bi-D adjustment during the AC power mode is performed.

In step S18, the second correction value of the battery mode is calculated using the first correction value.

In other words, the second correction value $\alpha 2$ is calculated using the equation $\alpha 2=\alpha 1\times K1$. The correction unit 84 of the computer 52 sets the acquired second correction value $\alpha 2$ in the correction value setting unit 72.

In step S19, a message is displayed indicating that the same paper is to be set. In other words, a message indicating that the same paper P onto which the test pattern TP1 illustrated in FIG. 10A is printed in the AC power mode (the high speed mode) is to be set in the feed tray 16 of the printer 11 is displayed on the display unit 14. There is a blank space region on the paper P illustrated in FIG. 10A in the regions outside of the test pattern TP1, and it is possible to print at least one test pattern TP in the blank space region.

In step S20, it is determined whether or not it is OK to print. In other words, it is determined whether or not an instruction to execute the printing of the test pattern is received due to the user operating the operation unit 15. When the print execution instruction is not received, and it is not OK to print, the process waits until it is OK to print, and if it is OK to print, the process proceeds to step S21. Note that, instead of an instruction performed by operating the operation unit 15, a configuration may be adopted in which it is not OK to print if the paper presence sensor 47 does not detect the paper P, and it is OK to print if the paper presence sensor 47 detects the paper P.

In step S21, the test pattern is printed based on the second correction value. In other words, the correction value acquisition unit 83 of the computer 52 reads out the test pattern data TD from the non-volatile memory 64 and acquires the second correction value $\alpha 2$ corresponding to the battery mode, and sequentially sets a plurality of correction values centered on the second correction value $\alpha 2$ in which the correction value is shifted for each predetermined shift amount in the correction value setting unit 72 in the process in which one pass is printed during the return motion. By printing each of the plurality of inspection patterns in order, the test pattern TP1 illustrated in FIG. 10A is printed onto the paper P, for example.

Figure 10B:
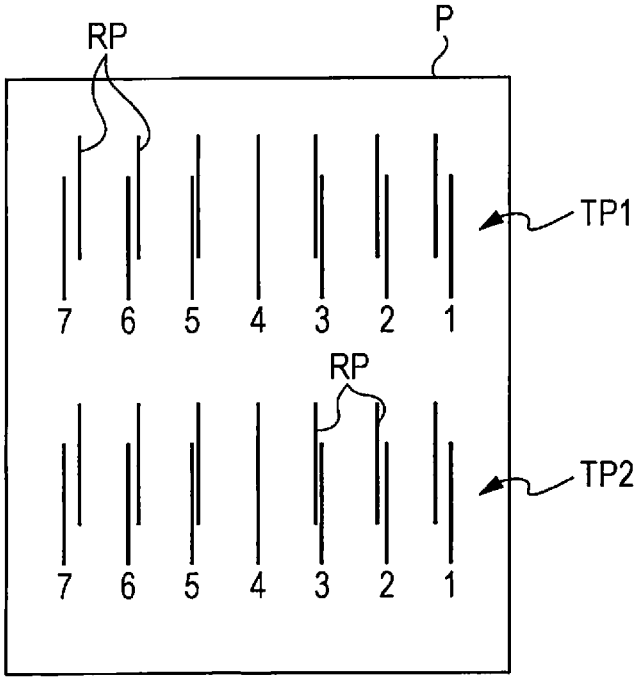

In step S22, it is determined whether or not the second correction value is OK, In other words, since the user views the test pattern TP2 and inputs the number corresponding to the inspection pattern with the smallest shift amount $\delta$ of the printing, if the number is the number "4" corresponding to the second correction value $\alpha 2$ in the example of FIGS. 8 and 10B, for example, it is determined that the second correction value $\alpha 2$ is OK. In this case, the second correction value $\alpha 2$ and the power supply mode information indicating that the power supply mode is the battery mode are stored in the predetermined storage region of the non-volatile memory 64.

In step S23, the correction coefficient is calculated based on the third correction value and the first correction value which are input. In other words, when the number corresponding to the inspection pattern with the smallest shift amount $\delta$ of the printing which is input by the user by the operation of the operation unit 15 after the user views the printed result of the test pattern TP2 is a number other than the number "4" which corresponds to the second correction value $\alpha 2$ in the example of FIG. 8, for example, the second correction value $\alpha 2$ is not OK. In this case, the correction coefficient is calculated using the third correction value which corresponds to the number which is input at this time and the first correction value. In other words, when a third correction value which differs from the second correction value $\alpha 2$ by more than a permissible range is selected, the correction coefficient is calculated using the third correction value and the first correction value. Here, the second correction value $\alpha 2$ is calculated using the equation $\alpha 2=\alpha 1\times K1$, in the second correction value $\alpha 2$ which is calculated using the correction coefficient K1, the shift amount $\delta$ of the printing which exceeds the permissible range occurs, and the shift amount $\delta$ of the printing in the third correction value $\alpha 3$ becomes the smallest. Therefore, the original correction coefficient K1old is multiplied by a value $(\alpha 3/\alpha 2)$, and the new correction coefficient K1 is calculated using $K1=(\alpha 3/\alpha 2)\cdot K1old$.

In step S24, the correction coefficient is updated. In other words, instead of the original correction coefficient K1, the new correction coefficient K1 is stored in the predetermined storage region of the non-volatile memory 64. In this manner, from the next time, since the second correction value $\alpha 2$ is calculated using the new correction coefficient K1, even if the ejection timing during the bidirectional printing is determined based on the second correction value $\alpha 2$ which is calculated from the first correction value $\alpha 1$, it is possible to perform the bidirectional printing under the conditions of the correction value with the smallest shift amount $\delta$ of the printing. As a result, a printed object with comparatively high quality is obtained.

Next, description will be given of the print control in which the bidirectional printing is performed by executing the program illustrated in the flowchart in FIG. 12 by the computer 52 after the Bi-D adjustment is performed as described above, with reference to FIG. 12. The print control is executed when the bidirectional printing is indicated when the computer 52 receives the print data. For example, when the user instructs the printing in an ordinary printing mode, since the bidirectional printing is instructed, the computer 52 executes the program illustrated in FIG. 12.

First, in step S31, the power supply mode is determined. In other words, it is determined whether the power supply mode is the AC power mode or the battery mode. If the power supply mode is the AC power mode, the process proceeds to step S32, and if the power supply mode is the battery mode, the process proceeds to step S39.

In step S32, the correction information CD is read out. In other words, the correction information CD is read out from the predetermined storage region of the non-volatile memory 64. When the Bi-D adjustment of the previous time is performed in the AC power mode, the correction information CD which is illustrated in FIG. 9A and contains the power supply mode information indicating that the power supply mode is the AC power mode and the first correction value $\alpha 1$ is read out. Meanwhile, when the previous Bi-D adjustment is performed in the battery mode, the correction information CD which is illustrated in FIG. 9B and contains the power supply mode information indicating that the power supply mode is the battery mode and the second correction value $\alpha 2$ is read out.

In step S33, it is determined whether or not the correction value is the first correction value $\alpha 1$. When the correction value is not the first correction value $\alpha 1$, that is, when the correction value is the second correction value $\alpha 2$, the process proceeds to step S34, and when the correction value is the first correction value α1, the process proceeds to step S35.

In step S34, the first correction value α1 is calculated using the second correction value α2 using the equation α1=α2×K2. In this manner, if the correction value which is stored in the non-volatile memory 64 is the first correction value α1 for the AC power mode, the correction value is used as it is; however, when the correction value is the second correction value α2, the first correction value α1 is acquired by calculation from the second correction value α2. The acquisition of the first correction value α1 is performed by the correction unit 84 of the computer 52. The correction unit 84 of the computer 52 sets the acquired first correction value α1 in the correction value setting unit 72.

In step S35, the ejection timing control of the print head is performed based on the first correction value α1. The ejection timing signal generation unit 73 sets a value (J−α1), which is obtained by subtracting the second correction value α2 which is loaded from the correction value setting unit 72 from the set value J, in the delay counter 87 as the target value. The ink ejection control of the print head 23 is performed from the point in time at which the reference pulse SP1 is input to the delay counter 87 based on the ejection timing signal PTS which is output from the ejection timing signal generation unit 73 when the count value which is obtained by counting the pulse of the counting pulse SP2 (refer to FIG. 7A for both the reference pulse SP1 and the counting pulse SP2) reaches a value of (J−α1) which is the target value. In this manner, the ink ejection timing control during the outward motion and during the return motion of the carriage 21 is performed appropriately, and high quality bidirectional printing is performed. In this step, one pass worth of printing is performed. The process proceeds to the next step S36 each time one pass worth of printing is performed.

In step S36, it is determined whether or not the printing is complete. In other words, it is determined whether or not the printing is complete each time one pass worth of printing is performed. If the printing is not complete, the process proceeds to the next step S37, and if the printing is complete, the routine ends. When the routine ends, the paper P for which the printing is complete is output.

In step S37, it is determined whether or not switching from the AC power supply to the battery power supply is detected. The detection unit 85 of the computer 52 detects switching from the AC power supply to the battery power supply due to a detection signal from the power device 51 when the plug 27*a* is pulled out from the AC power electrical outlet or when there is a power outage during the AC power mode. If switching is not detected, the process returns to step S35, and when the carriage 21 performs the scan of the next pass, the printing of the next pass is performed by performing the ejection timing control of the print head in the process of the scan. Meanwhile, if switching is detected, the process proceeds to step S38.

In step S38, the printing is stopped and the paper is output. The reason that the printing is stopped is because, when the speed of the fixed speed region of the print head 23 is changed part way through a pass, since lines are formed in the printed image, the speed may not be changed from the high speed mode to the low speed mode part way through a pass, whereas, when the high speed mode is maintained, the power consumption of the carriage motor 35 is great and there is a concern that this will cause the system to go down. In the present example, this is because, even if the CR•PF overlap control is performed during the printing in the AC printing mode and the high speed mode may be hypothetically maintained, there is a concern that the power will be insufficient in the battery power supply during the execution period of the overlap control in which the plurality of motors 35 and 42 are driven at the same time, leading to the system going down. Therefore, when switching from the AC power supply to the battery power supply is detected during the printing, the printing is stopped and the paper is output.

Meanwhile, when it is determined that the power supply mode is the battery mode in step S31, in step S39, the correction information CD is read out. In other words, the correction information CD is read out from the predetermined storage region of the non-volatile memory 64.

In step S40, it is determined whether or not the correction value is the second correction value α2. When the correction value is not the second correction value α2, that is, when the correction value is the first correction value α1, the process proceeds to step S41, and when the correction value is the second correction value α2, the process proceeds to step S42.

In step S41, the second correction value α2 is calculated using the first correction value α1 using the equation α2=α1×K1. In this manner, if the correction value which is stored in the non-volatile memory 64 is the second correction value α2 for the battery mode, the correction value is used as it is; however, when the correction value is the first correction value α1, the second correction value α2 is acquired by calculation from the first correction value α1. The acquisition of the second correction value α2 is performed by the correction unit 84 of the computer 52. The correction unit 84 of the computer 52 sets the acquired second correction value α2 in the correction value setting unit 72.

In step S42, the ejection timing control of the print head is performed based on the second correction value α2. In other words, the ejection timing signal generation unit 73 sets a value (J−α2), which is obtained by subtracting the first correction value α1 which is loaded from the correction value setting unit 72 from the set value J, in the delay counter 87 as the target value. The ink ejection control of the print head 23 is performed from the point in time at which the reference pulse SP1 is input to the delay counter 87 based on the ejection timing signal PTS which is output from the ejection timing signal generation unit 73 when the count value which is obtained by counting the pulse of the counting pulse SP2 (refer to FIG. 7B for both the reference pulse SP1 and the counting pulse SP2) reaches a value of (J−α2) which is the target value. In this manner, the ink ejection timing control during the outward motion and during the return motion of the carriage 21 is performed appropriately, and high quality bidirectional printing is performed. In this step, one pass worth of printing is performed. The process proceeds to the next step S43 each time one pass worth of printing is performed.

In step S43, it is determined whether or not the printing is complete. In other words, it is determined whether or not the printing is complete each time one pass worth of printing is performed. If the printing is not complete, the process proceeds to the next step S44, and if the printing is complete, the routine ends. When the routine ends, the paper P for which the printing is complete is output.

In step S44, it is determined whether or not switching from the battery power supply to the AC power supply is detected. The detection unit 85 of the computer 52 detects switching from the battery power supply to the AC power supply due to a detection signal from the power device 51 when the plug 27*a* is inserted into the AC power electrical outlet or when there is a recovery from a power outage during the battery mode. If switching is not detected, the process returns to step S42, and when the carriage 21 performs the scan of the next pass, the printing of the next pass is performed by performing the ejection timing control of the print head in the process of the scan. Meanwhile, if switching is detected, the process proceeds to step S45.

In step S45, the battery mode (the low speed mode) continues for the current pass, and the printing is performed. For example, even if the power supply mode switches from the battery power supply to the AC power supply part way through the current pass, the battery mode (the low speed mode) is maintained as it is for the current pass, and the process completes. This is because, when the speed of the fixed speed region of the print head 23 is changed part way through a pass, lines are formed in the printed image. Therefore, a change in speed from the low speed mode to the high speed mode is not performed part way through a pass. When the current pass completes, the process proceeds to step S33 of the case of the AC power mode.

If the correction value is not the first correction value $\alpha 1$ (negative determination in S33), in step S34, the first correction value $\alpha 1$ is calculated using the second correction value $\alpha 2$ using the equation $\alpha 1=\alpha 2\times K2$. The correction unit 84 of the computer 52 sets the acquired first correction value $\alpha 1$ in the correction value setting unit 72. Therefore, in the next pass, the ejection timing control of the print head 23 is performed based on the first correction value $\alpha 1$ (S35). At this time, the ejection timing signal generation unit 73 sets a value ($J-\alpha 1$), which is obtained by subtracting the first correction value $\alpha 1$ which is loaded from the correction value setting unit 72 from the set value J, in the delay counter 87 as the target value. The ink ejection control of the print head 23 is performed from the point in time at which the reference pulse SP1 is input to the delay counter 87 based on the ejection timing signal PTS which is output from the ejection timing signal generation unit 73 when the count value which is obtained by counting the pulse of the counting pulse SP2 (refer to FIG. 7A for both the reference pulse SP1 and the counting pulse SP2) reaches a value of ($J-\alpha 1$) which is the target value. In this manner, the ink ejection timing control during the outward motion and during the return motion of the carriage 21 is performed appropriately, and high quality bidirectional printing is performed. In this step, one pass worth of printing is performed. The process proceeds to the next step S36 each time one pass worth of printing is performed. In this manner, in the passes from the next pass onward, the printing is performed in the high speed mode until the printing completes (positive determination in S36) if there is no switching from the AC power supply to the battery power supply or the like.

According to the present embodiment, as described in detail above, it is possible to obtain the following effects.

(1) The correction value acquisition unit 83 performs the Bi-D adjustment in one speed mode of the plurality of speed modes in the bidirectional printing, bidirectionally prints the test pattern TP, and acquires the correction value (the first correction value) based on the printed result of the test pattern TP. The correction information CD containing the information relating to the speed mode when the test pattern, TP is printed and the correction value is stored in the predetermined storage region of the non-volatile memory 64, which is an example of a storage unit. The correction value (the second correction value) of the other speed mode is calculated using the correction value (the first correction value) which is acquired in the Bi-D adjustment. Therefore, it is not necessary for the user to perform the Bi-D adjustment for each speed mode. It is sufficient to perform a series of setting tasks only once, the setting tasks including the printing of the test pattern TP, the input operation of the selected data of the number or the like with the smallest shift amount $\delta$ by viewing the printed result of the test pattern TP, and the like.

(2) The power device 51 (an example of a power supply unit) is further provided, and is capable of selecting the AC power supply (a first power supply) which converts an alternating current from the commercial power source 30 to a direct current and supplies power, and the battery power supply (a second power supply) which supplies the direct current from the battery 28. Using the correction value which is acquired by performing the Bi-D adjustment in one of the power supply modes of the AC power mode (the first power supply mode) which is the high speed mode, and the battery mode (the second power supply mode) which is the low speed mode, the correction value which is used in the other power supply mode is acquired by calculation. Therefore, it is not necessary for the user to perform the Bi-D adjustment for each power supply mode. For example, it is sufficient to perform the Bi-D adjustment only once in one power supply mode.

(3) Since the calculation of the correction value using the correction value which is stored in the non-volatile memory 64 is performed at the printing start time of the power supply mode, one correction value may be stored in the non-volatile memory 64. Therefore, little storage capacity, which is used for the storage of the correction value in the non-volatile memory 64, is sufficient. For example, when a configuration is adopted in which the other correction value which is calculated from the correction value is also stored in the non-volatile memory 64, the memory capacity of a plurality (for example, two) of correction values is always used, and the capacity of the non-volatile memory 64 which can be used for other purposes is reduced. However, in the present embodiment, since only the capacity in which the information of one correction value (including one item of power supply mode information) can be stored is used, it is possible to secure more storage capacity in the non-volatile memory 64 which can be used for other uses. Since the correction value which is subsequently acquired is overwritten in the non-volatile memory 64, a small amount of storage capacity of the non-volatile memory 64 which is necessary for the storage of the correction value is sufficient.

(4) When the detection unit 85 detects that the power supply by the power device 51 switches from the AC power supply (an example of the first power supply) to the battery power supply (an example of the second power supply) during the bidirectional printing in which the carriage 21 and the print head 23 are controlled, the main control unit 81 stops the ejection of the ink droplets from the print head 23, and the paper P (an example of the medium) is output. When the speed (the fixed speed) of the print head 23 is changed in the fixed speed region part way through a pass of the carriage 21, since lines are formed in the printed image, the speed may not be changed from the high speed mode to the low speed mode part way through a pass, whereas, when the high speed mode is maintained, the power consumption of the carriage motor 35 is great and there is a concern that this will cause the system to go down. However, since the printing is stopped and the paper P is output, it is possible to avoid the system going down. Even if the CR•PF overlap control is performed during the printing in the AC power mode and the high speed mode may be hypothetically maintained, there is a concern that the power in the battery power supply will be insufficient in the period in which the overlap control, in which the plurality of motors 35 and 42 are driven at the same time, is executed, leading to the system going down. However, in the present embodiment, since the printing is stopped, it is possible to avoid lines forming in the printed image in this manner, or the system going down.

(5) When the detection unit 85 detects that the power supply by the power device 51 switches from the battery power supply (an example of the second power supply) to the AC power supply (an example of the first power supply) during the bidirectional printing in which the carriage 21 and the print head 23 are controlled by the main control unit 81, if scanning of the carriage 21 is underway, the main control unit 81 causes the current pass (one scan) to be driven at the speed of the case of the battery power supply. The ejection timing of the print head 23 in the bidirectional printing is controlled using the first correction value $\alpha 1$ during the AC power supply from the next pass (scan) of the carriage 21. Therefore, in addition to being able to avoid the formation of lines in the printed image caused by a variation in the carriage speed part way through a pass, it is possible to perform the bidirectional printing in the high speed mode from the next pass.

(6) Since the test pattern TP2 is printed based on the correction value of a calculated result, a user can confirm whether or not the calculated correction value is appropriate by viewing the printed result of the test pattern TP2. When the user views the printed result of the test pattern TP2 and the correction value is not appropriate, the user can set the appropriate correction value in the printer 11 by selecting the number corresponding to the inspection pattern (the ruled line pair RP) that the user determines to be appropriate and inputting the number by operating the operation unit 15.

(7) The printer 11 is provided with a learning function which changes (updates) the coefficients K1 and K2 in which the second correction value according to the number which is input by the user after the user views the printed result of the test pattern TP2 may be obtained by calculation from the first correction value according to the number which is input by the user after the user views the printed result of the test pattern TP1 which is printed beforehand. Accordingly, even if the coefficients K1 and K2 become inappropriate for reasons such as degradation with the passage of time, it is possible to calculate the other correction value as a comparatively appropriate value from one correction value across a long period due to the updating of the coefficients K1 and K2 by the learning function. Therefore, across a long period, it is possible to perform the bidirectional printing with a small shift amount $\delta$ of the printing in the outward motion and the return motion.

(8) Since the printing of the test pattern TP2 for confirmation is printed on a different printing area of the surface of the same side of the same sheet of paper P, even if the two test patterns TP1 and TP2 are printed, it is sufficient for one sheet of paper P to be consumed. Accordingly, since it is possible to save the number of sheets of the paper P such that few are used in consideration of the number of test patterns which are printed, in addition to two types of the test pattern TP1 and TP2 with different power supply modes (that is, speed modes) being printed on a different printing area of the surface of the same side of the same sheet of paper P, it is easy for the user to compare the test patterns TP1 and TP2 to each other.

Note that, the embodiment described above can also be modified to the forms described below.

A learning function may be provided in which, when the Bi-D adjustment is carried out in different speed modes (power supply modes) within a comparatively short predetermined period, a numerical constant (for example, a coefficient) in a computation equation is changed (updated) using the first correction value $\alpha 1$ and the second correction value $\alpha 2$ which are respectively acquired from two test patterns of the different speed modes such that from one of the correction values $\alpha 1$ and $\alpha 2$, the other is acquired.

In this case, even if the initial correction value becomes an inappropriate value due to degradation with the passage of time, since it is possible to update the correction value to an appropriate value using the learning function, it is possible to acquire a comparatively high quality printed image during the bidirectional printing across a long period. Here, the predetermined period is not limited to a period which can be considered to be the same time within 5 minutes, for example, and may be a predetermined time spanning 1 hour to 1 day, for example, and further, may be a predetermined time spanning 1 day to 1 month, for example. Even in such a predetermined period, even when the Bi-D adjustment is performed in different speed modes in the predetermined period, it is possible to update the numerical constant (for example, the coefficient) in the computation equation using the learning function. Even in this case, since it is possible to calculate the other correction value with an appropriate value from one correction value by updating the numerical constant using the learning function, even if the numerical constant in the computation equation is no longer an appropriate value for reasons such as degradation with the passage of time, it is possible to acquire a comparatively high quality printed image during the bidirectional printing across a long period.

The acquisition method of the correction value is not limited to a method in which the user views the test pattern and determines and inputs a number corresponding to the inspection pattern with the smallest shift amount $\delta$ of the printing. For example, a method may be adopted in which the inspection pattern on the paper is read by an imaging sensor which is installed in the carriage 21, the shift amount $\delta$ of the printing in the outward path and the return path is measured automatically using image processing, and the correction value is set by storing the correction value corresponding to the inspection pattern with the smallest shift amount $\delta$ in the non-volatile memory 64. It is also possible to adopt a configuration in which the correction value is set automatically by performing the printing of the test pattern and the detection of the shift amount $\delta$ of the printing as an initialization process which is executed the first time the printer is started after purchase, or, as maintenance which is performed regularly or irregularly by the user. When the printer 11 is a multifunction device provided with a scanner, a method may be adopted in which the correction value is set by obtaining the inspection pattern with the smallest shift amount $\delta$ of the printing using image processing due to the user setting the paper P onto which the test pattern is printed on a document stand of the scanner and reading the image of the test pattern, and storing the correction value corresponding to the inspection pattern in the non-volatile memory 64.

The gap between the support stand 38 and the print head 23 may differ between different speed modes. When the gap differs, correction coefficients which consider the gap may be used. For example, the faster the speed mode is, and the greater the gap is, the larger the value may be used for the correction coefficient.

The plurality of speed modes with different carriage speeds in the bidirectional printing may be three or more.

For example, the three modes of low speed, medium speed, and high speed may be set in the bidirectional printing.

The inspection patterns contained in the test pattern are not limited to the ruled line pairs RP. The inspection patterns may be a pattern of another shape from which the shift amount δ of the printing in the scanning direction can be ascertained. For example, an inspection pattern may be adopted in which the inspection pattern is a pattern of three vertically long bar shapes lined up in the scanning direction, in which the bar which is positioned in the center is printed during the outward motion, for example, and the other bars which form a pair, one on the left side and one on the right side of the center bar, are printed during the return motion.

Although notification is performed using the display unit (an example of the notification unit) to display a message indicating that the same paper P is to be set, notification of the fact may be performed using audio using a speaker (an example of the notification unit), for example.

A configuration may be adopted in which the CR•ASF overlap control is not carried out during the AC power mode. A configuration may be adopted in which the CR•PF overlap control is not carried out during the AC power mode.

The learning function which updates the numerical constant in the computation equation may be removed.

The correction values α1 and α2 are not limited to values which are converted from count values of the counting pulse of the distance from the ejection start position to the landing position DP illustrated in FIGS. 7A and 7B, and delay values (J−α1) and (J−α2) which are obtained by subtracting the values α1 and α2 which are converted from the count values of the distance from the set value J may be used as the correction values.

The first test pattern TP1 and the second test pattern TP2 may be printed on separate sheets of paper.

A configuration may be adopted in which, in the bidirectional printing, for example, the printing is performed at a defined ejection timing during the outward motion, and the ejection timing during the return motion is corrected such that the ink droplets may be caused to land in the same positions during the return motion as the landing positions during the outward motion.

The numerical constant in the computation equation which is used when acquiring, from one correction value which is acquired in the Bi-D adjustment, another correction value by calculation is not limited to a coefficient which is multiplied by the correction value, and may be a numerical constant which is added to or subtracted from the correction value. For example, a configuration may be adopted in which, using a computation equation which adds or subtracts a delay value adjustment numerical constant in relation to one correction value which is read out from the non-volatile memory 64, the other correction value is calculated.

Although a direct current is supplied to the printer 11 via the AC adapter, a configuration may be adopted in which the power device 51 (an example of the AC power unit) in the apparatus main body 12 is provided with a rectification function in which an alternate current from the commercial power source 30 is supplied to the printer 11 and the power device 51 converts the alternating current to a direct current.

Although the printer 11 is provided with two types of power unit, the AC power unit and the battery, a configuration may be adopted in which only one of the two is used as the power unit. In other words, the printer may be driven by only the AC power unit without being provided with the battery, the printer may be driven by only the battery 28 without being provided with the AC power unit, or the like. Even in a configuration with only the AC power unit, it is possible to continue the driving of the motors while avoiding the system going down.

The functional units which configure the print control unit 71 may be realized in software by a CPU which executes a program, may be realized in hardware by an electronic circuit such as an ASIC, may be realized by cooperation between software and hardware, or the like.

The printer (the printing apparatus) which is an example of the liquid ejecting apparatus is not limited to a printer which is provided with only a printing function, and may be a multifunction device, as long as the printer is capable of printing onto a medium such as the paper P.

The printing apparatus is not limited to a serial printer, and may be a lateral printer.

The medium is not limited to paper, and may be a resin film, a metal foil, a metal film, a composite film of a resin and a metal (a laminate film), a textile, a non-woven fabric, a ceramic sheet, or the like.

The entire discovery of Japanese Patent Application No. 2014-171266, filed Aug. 26, 2014 is expressly incorporated by reference herein.

What is claimed is:

1. A liquid ejecting apparatus, comprising:

a liquid ejecting head which is capable of ejecting a liquid;

a carriage which is capable of moving reciprocally in a scanning direction which intersects a transport direction of a medium;

a control unit which causes the liquid ejecting apparatus to perform bidirectional printing by causing the carriage to move reciprocally in a plurality of speed modes in which an ejection mode of the liquid ejecting head is the same and a movement speed of the carriage is different, and causing the liquid to be ejected from a nozzle of the liquid ejecting head in both an outward motion and a return motion of the carriage;

a correction value acquisition unit which performs the bidirectional printing of a test pattern using a correction value which corresponds to one speed mode of the plurality of speed modes, acquires a correction value based on a printed result of the test pattern, and stores correction information containing information of the speed mode of when the test pattern is printed and the correction value in a storage unit;

a correction unit which corrects an ejection timing of the liquid ejecting head according to the speed mode which is applied based on the correction information; and a power supply unit which is capable of selecting a first power supply which converts an alternating current from an alternating current power source to a direct current and supplies power, and a second power supply which supplies a direct current from a battery, wherein the plurality of speed modes contains a first power supply mode in which the movement speed of the carriage during the first power supply is set to a relatively high speed, and a second power supply mode in which the movement speed of the carriage during the second power supply is set to a relatively low speed in comparison to during the first power supply, wherein the correction value acquisition unit performs the bidirectional printing of the test pattern in one power supply mode of the first power supply mode and the second power supply mode, acquires a correction value based on a printed result of the test pattern, and stores correction information containing information of the power supply mode of when the correction value is obtained and the correction value in the storage unit, and wherein the correction unit obtains a correction value which corrects the ejection timing of the liquid ejecting head in the power supply mode which is applied based on the power supply mode which is applied and the correction information.

2. The liquid ejecting apparatus according to claim 1, wherein, when a power supply which is performed by the power supply unit during printing in which the carriage and the liquid ejecting head are controlled changes from the first power supply to the second power supply, the control unit stops ejection of the liquid from the liquid ejecting head and outputs the medium which is a target of the stopped liquid ejection.

3. The liquid ejecting apparatus according to claim 2, wherein, when the power supply which is performed by the power supply unit during the printing in which the carriage and the liquid ejecting head are controlled changes from the second power supply to the first power supply part way through a scan of the carriage, the control unit continues control in the second power supply mode during the scan, switches to control of the first power supply mode from a next scan of the carriage, and controls the ejection timing of the liquid ejecting head using the correction value of the first power supply mode.

4. The liquid ejecting apparatus according to claim 3, wherein the correction value acquisition unit overwrites the correction value in the storage unit with a correction value which is subsequently acquired.

5. The liquid ejecting apparatus according to claim 4, wherein, when correction is carried out on the ejection timing which aligns landing positions of the liquid in both directions during the bidirectional printing in the one speed mode of the plurality of speed modes, and when the bidirectional printing is performed in another speed mode, the correction value which is acquired in the one speed mode is multiplied by a coefficient corresponding to the other speed mode to acquire a correction value of when the bidirectional printing is performed in the other speed mode.

6. The liquid ejecting apparatus according to claim 5, wherein, when the control unit forms a first test pattern by performing the bidirectional printing in the one speed mode when correcting the ejection timing which aligns the landing positions of the liquid in both directions during the bidirectional printing in the one speed mode of the plurality of speed modes, and acquires a correction value based on a printed result of the first test pattern, the control unit calculates a correction value of the other speed mode based on the acquired correction value and prints a second test pattern in the other speed mode based on the calculated correction value.

7. The liquid ejecting apparatus according to claim 6, wherein after outputting the medium for which the printing of the first test pattern is complete, the control unit performs notification indicating that the medium is to be set in a feed position using a notification unit, and prints the second test pattern onto a different printing area from the printing area of the first test pattern on the medium.

8. The liquid ejecting apparatus according to claim 7, wherein, when a calculated second correction value which is obtained by calculation using a first correction value which is selected from the printed result of the first test pattern differs from the actual second correction value which is selected from the printed result of the second test pattern in excess of a permissible range, the control unit performs learning in which a numerical constant which is used in the calculation is updated to a value which is obtained using the actual second correction value.

* * * * *